US007455380B2

(12) United States Patent
Takeishi

(10) Patent No.: US 7,455,380 B2
(45) Date of Patent: Nov. 25, 2008

(54) PRINTING APPARATUS, MEDIA DETECTION APPARATUS, MEDIA DETECTION METHOD, MEASUREMENT METHOD, COMPUTER-READABLE STORAGE MEDIUM, AND PRINTING SYSTEM

(75) Inventor: Tetsuji Takeishi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 329 days.

(21) Appl. No.: 11/101,646

(22) Filed: Apr. 8, 2005

(65) Prior Publication Data

US 2005/0231544 A1 Oct. 20, 2005

(30) Foreign Application Priority Data

Apr. 9, 2004 (JP) ..... 2004-115218

(51) Int. Cl.
*B41J 29/38* (2006.01)
*B41J 13/26* (2006.01)

(52) U.S. Cl. ..... 347/19; 347/5; 347/14; 400/709

(58) Field of Classification Search ..... 347/16, 347/19, 249, 5, 14; 400/709, 634
See application file for complete search history.

(56) References Cited

U.S. PATENT DOCUMENTS 5,721,581 A * 2/1998 Saito et al. ..... 347/249
2004/0028450 A1 * 2/2004 Jung ..... 400/709

FOREIGN PATENT DOCUMENTS

JP 2003-63080 A 3/2003

* cited by examiner

*Primary Examiner*—Lam S Nguyen
(74) *Attorney, Agent, or Firm*—Sughrue Mion, PLLC

(57) ABSTRACT

A printing apparatus includes: a carrying mechanism that carries a medium; a printing section that carries out printing with respect to the medium; a contact sensor that detects the medium by coming into contact with the medium that is carried by the carrying mechanism; a controller that receives a signal that is output from the contact sensor; and a memory that stores measurement data of a time from when the contact sensor and the medium enter a non-contact state until a signal that is output from the contact sensor and that indicates that the medium is not being detected is received by the controller.

15 Claims, 19 Drawing Sheets

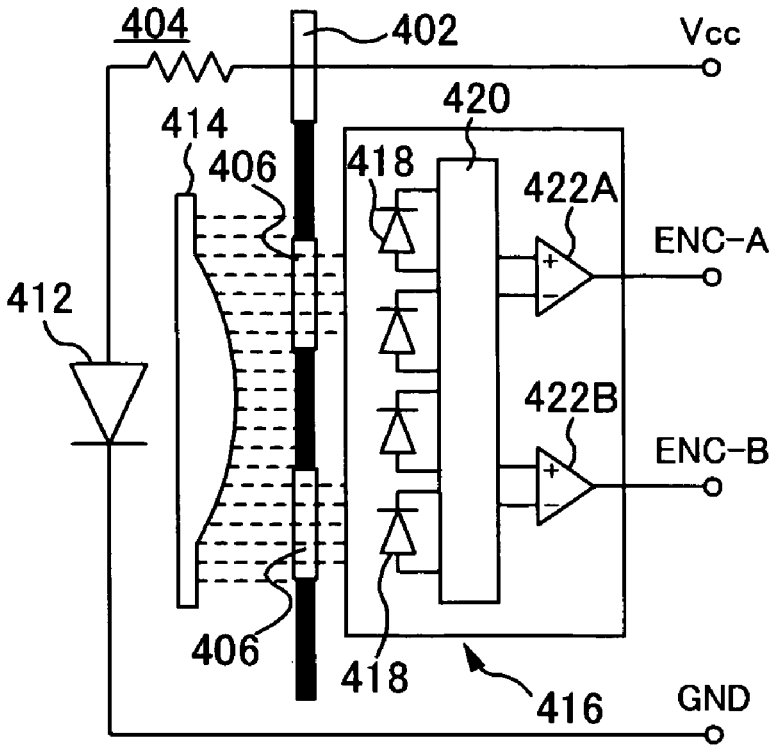
FIG.7
FIG. 8A
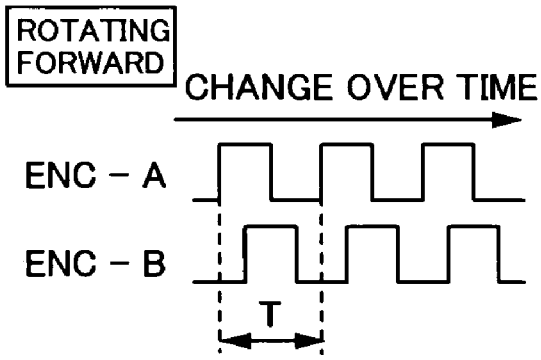
FIG. 8B
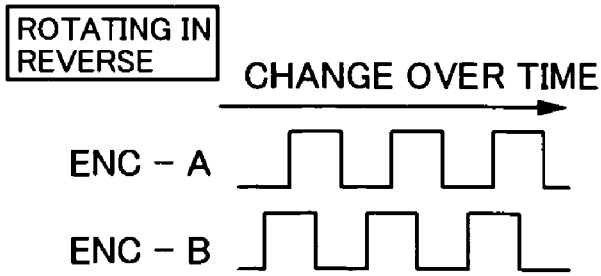

| | CARRY AMOUNT (NUMBER OF STEPS) | OBTAINED TIME (μs) |
|---|---|---|
| n | | |
| n−1 | | |
| ⋮ | ⋮ | ⋮ |
| 14 | 2260 | 1300 |
| 13 | 2230 | 1200 |
| 12 | 2180 | 1100 |
| 11 | 2100 | 1000 |
| 10 | 2000 | 900 |
| 9 | 1850 | 800 |
| 8 | 1700 | 700 |
| 7 | 1550 | 600 |
| 6 | 1400 | 500 |
| 5 | 1300 | 400 |
| 4 | 1240 | 300 |
| 3 | 1200 | 200 |
| 2 | 1010 | 100 |
| 1 | 1000 | 0 |

TIMING AT WHICH MEDIA NON-DETECTION SIGNAL IS RECEIVED → 13

TIMING OF ACTUAL SEPARATION OF LEVER → 5

FIG.19

PRINTING APPARATUS, MEDIA DETECTION APPARATUS, MEDIA DETECTION METHOD, MEASUREMENT METHOD, COMPUTER-READABLE STORAGE MEDIUM, AND PRINTING SYSTEM

CROSS-REFERENCE TO RELATED APPLICATIONS

The present application claims priority upon Japanese Patent Application No. 2004-115218 filed on Apr. 9, 2004, which is herein incorporated by reference.

BACKGROUND OF THE INVENTION

1. Field of the Invention

The present invention relates to printing apparatuses, media detection apparatuses, media detection methods, measurement methods, computer-readable storage media, and printing systems.

2. Description of the Related Art

When carrying out printing on a medium such as paper, various printing apparatuses such as inkjet printers execute printing by, for example, supplying the medium from a paper-supply portion and ejecting ink onto the medium while carrying the supplied medium in a predetermined direction. In such printing apparatuses, a sensor is provided (see JP 2003-63080A for example) to confirm the presence of the medium so that a printing operation is not executed when a medium has not been supplied from the paper-supply portion.

The sensor is arranged at the paper-supply portion side of the printing apparatus and confirms whether or not the medium has been supplied to a predetermined position. Ordinarily, a contact-type sensor that detects the medium when contact is made with the medium is used for this sensor. The contact-type sensor is provided with a lever, for example, that contacts the medium and, when the lever rotates due to contact with the medium, outputs a signal indicating that a medium has been detected. Furthermore, when the lever moves away from the medium and returns to its original position, the sensor outputs a signal indicating that the medium is not being detected.

However, contact-type sensors provided with such a lever or the like have the following problems. Namely, a slight time difference occurs from when the medium and the sensor enter a non-contact state until the sensor outputs a signal indicating that the medium is not being detected, and therefore it is extremely difficult to accurately obtain the timing at which the sensor and the medium actually entered a non-contact state. In particular, since the respective time differences are different for respective sensors even for the same type of sensor due to the installed position of the sensor, manufacturing error, and the like, it is extremely difficult to estimate the correct timing at which the sensor and the medium enter a non-contact state.

Being unable to obtain the timing at which the sensor and the medium entered a non-contact state has caused the following inconveniences. Namely, since the timing at which the medium and the sensor entered a non-contact state is not known when attempting to detect the position of a rear end portion of the medium after the medium and the sensor have gone into a non-contact state, it has not been possible to determine the correct position of the medium. For this reason, it has been extremely difficult to determine the position of the rear end portion of the medium when, for example, carrying the medium slowly so as to ensure the rear end portion does not rise up when the rear end portion of the medium passes the carry rollers, or when executing "borderless printing" in which printing is carried out to the very end of the rear end portion of the medium. For this reason, inconveniences have occurred, such as extra time being taken in processing, which tends to reduce printing speed, and extra ink having to be ejected.

SUMMARY OF THE INVENTION

The present invention has been devised with consideration to such circumstances, and it is an object of the present invention to enable the timing at which the sensor and the medium entered a non-contact state to be obtained accurately.

An aspect of the invention is a printing apparatus comprising: a carrying mechanism that carries a medium; a printing section that carries out printing with respect to the medium; a contact sensor that detects the medium by coming into contact with the medium that is carried by the carrying mechanism; a controller that receives a signal that is output from the contact sensor; and a memory that stores measurement data of a time from when the contact sensor and the medium enter a non-contact state until a signal that is output from the contact sensor and that indicates that the medium is not being detected is received by the controller.

Other features of the present invention will become clear by reading the description of the present specification with reference to the accompanying drawings.

BRIEF DESCRIPTION OF THE DRAWINGS

FIG. 7 is a block diagram illustrating the configuration of a detection section 404 of a rotary encoder 134.

FIG. 8A is a timing chart of the output waveforms of the linear encoder during forward rotation.

FIG. 8B is a timing chart of the output waveforms of the linear encoder during reverse rotation.

FIG. 19 is an explanatory diagram for describing an example of use of the measurement data.

DETAILED DESCRIPTION OF THE INVENTION

Figure 1:
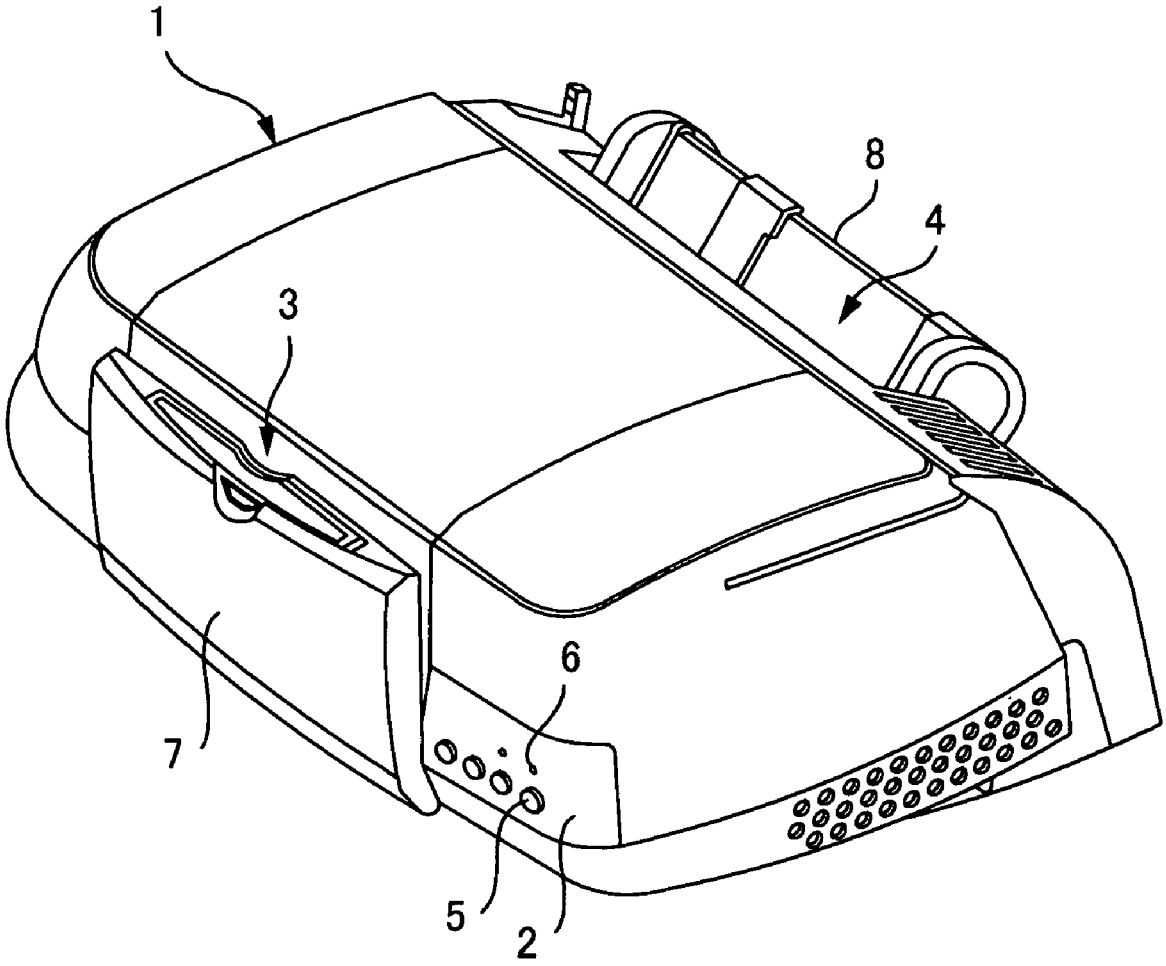
FIG. 1 is a perspective view of one embodiment of a printing apparatus according to the present invention.

At least the following matters will be made clear by the explanation in the present specification and the description of the accompanying drawings.

A printing apparatus is provided with: a carrying mechanism that carries a medium; a printing section that carries out printing with respect to the medium; a contact sensor that detects the medium by coming into contact with the medium that is carried by the carrying mechanism; a controller that receives a signal that is output from the contact sensor; and a memory that stores measurement data of a time from when the contact sensor and the medium enter a non-contact state until a signal that is output from the contact sensor and that indicates that the medium is not being detected is received by the controller.

With this printing apparatus, it is possible to obtain the timing at which the contact sensor and the medium actually entered a non-contact state based on measurement data stored in the memory.

With this printing apparatus, a timing at which the contact sensor and the medium enter a non-contact state may be obtained based on the measurement data stored in the memory and a timing at which a signal that is output from the contact sensor and that indicates that the medium is not being detected is received by the controller. With such a method, it is possible to easily obtain the timing at which the contact sensor and the medium enter a non-contact state.

With this printing apparatus, a position of the medium being carried by the carrying mechanism may be detected based on the timing at which the contact sensor and the medium enter a non-contact state and a carry amount by which the carrying mechanism carries the medium. With such a method, it is possible to easily obtain the position of the medium.

Furthermore, the printing apparatus may further comprise a non-contact sensor that is arranged at a position away from the contact sensor and that is adapted to detect, in a non-contact state, the medium carried by the carrying mechanism. By providing this non-contact sensor, it is possible to easily obtain measurement data of the time from when the contact sensor and the medium enter a non-contact state until a signal that is output from the contact sensor and that indicates that the medium is not being detected is received by the controller.

Furthermore, with this printing apparatus, the non-contact sensor may be an optical sensor. By using an optical sensor, it is possible to easily achieve non-contact detection of the medium.

Furthermore, with this printing apparatus, the measurement data may be obtained based on a detection signal regarding the medium that is output from the contact sensor and a detection signal regarding the medium that is output from the non-contact sensor. With such a method, it is possible to easily obtain the measurement data.

Furthermore, with this printing apparatus, the medium may be carried at a predetermined carry velocity by the carrying mechanism when obtaining the measurement data. By carrying the medium at a predetermined carry velocity in this way, it is possible to easily obtain the measurement data.

Furthermore, with this printing apparatus, the medium may be carried at least two times at different carry velocities by the carrying mechanism when obtaining the measurement data. By carrying the medium at least two times at a different carry velocity in this way, it is possible to easily obtain the measurement data.

Furthermore, with this printing apparatus, the contact sensor may comprise a lever that rotates by coming into contact with the medium. When the contact sensor is provided with such a lever, it can be optimally applied.

Further, a printing apparatus comprises: a carrying mechanism that carries a medium; a printing section that carries out printing with respect to the medium; a contact sensor that detects the medium by coming into contact with the medium that is carried by the carrying mechanism; a controller that receives a signal that is output from the contact sensor; and a memory that stores measurement data of a time from when the contact sensor and the medium enter a non-contact state until a signal that is output from the contact sensor and that indicates that the medium is not being detected is received by the controller; wherein a timing at which the contact sensor and the medium enter a non-contact state is obtained based on the measurement data stored in the memory and a timing at which a signal that is output from the contact sensor and that indicates that the medium is not being detected is received by the controller; wherein a position of the medium being carried by the carrying mechanism is detected based on the timing at which the contact sensor and the medium enter a non-contact state and a carry amount by which the carrying mechanism carries the medium; wherein the printing apparatus further comprises a non-contact sensor that is arranged at a position away from the contact sensor and that is adapted to detect, in a non-contact state, the medium carried by the carrying mechanism; wherein the non-contact sensor is an optical sensor; wherein the measurement data is obtained based on a detection signal regarding the medium that is output from the contact sensor and a detection signal regarding the medium that is output from the non-contact sensor; wherein the medium is carried at a predetermined carry velocity by the carrying mechanism when obtaining the measurement data; wherein the medium is carried at least two times at different carry velocities by the carrying mechanism when obtaining the measurement data; and wherein the contact sensor comprises a lever that rotates by coming into contact with the medium.

Further, a media detection apparatus comprises: a contact sensor that detects a medium by coming into contact with the medium that is carried by a carrying mechanism; a controller that receives a signal that is output from the contact sensor; and a memory that stores measurement data of a time from when the contact sensor and the medium enter a non-contact state until a signal that is output from the contact sensor and that indicates that the medium is not being detected is received by the controller.

Further, a method of detecting a medium, comprises the steps of: measuring a time from when a medium and a contact sensor of a media detection apparatus that detects the medium by coming into contact therewith enter a non-contact state until a signal that is output from the contact sensor and that indicates that the medium is not being detected is received by a controller of the media detection apparatus; and storing the time that has been measured in a memory of the media detection apparatus as measurement data.

Further, a measurement method comprises the steps of: detecting a medium that is being carried at a predetermined carry velocity using a contact sensor of a media detection apparatus that detects the medium by coming into contact therewith; detecting the medium that is being carried at the predetermined carry velocity using a non-contact sensor that is arranged at a position away from the contact sensor and that is adapted to detect, in a non-contact state, the medium; and based on a signal output from the contact sensor and a signal output of the non-contact sensor, measuring a time from when the medium and the contact sensor enter a non-contact state until a signal that is output from the contact sensor and that indicates that the medium is not being detected is received by a controller of the media detection apparatus.

Further, a computer-readable storage medium has recorded thereon a program, the program being executed on a printing apparatus provided with: a carrying mechanism that carries a medium, a printing section that carries out printing with respect to the medium, a contact sensor that detects the medium by coming into contact with the medium that is carried by the carrying mechanism, a controller that receives a signal that is output from the contact sensor, and a memory that stores data; and the program executing the steps of: carrying the medium by the carrying mechanism at a predetermined carry velocity; and when the medium is carried by the carrying mechanism at the predetermined carry velocity, measuring a time from when the medium and the contact sensor enter a non-contact state until a signal that is output from the contact sensor and that indicates that the medium is not being detected is received by the controller, based on: a signal that is output from the contact sensor, and a signal that is output from a non-contact sensor that is arranged at a position away from the contact sensor and that is adapted to detect, in a non-contact state, the medium being carried by the carrying mechanism.

Further, a printing system comprises: a main computer unit; and a printing apparatus that is connectable to the main computer unit and that is provided with: a carrying mechanism that carries a medium, a printing section that carries out printing with respect to the medium, a contact sensor that detects the medium by coming into contact with the medium that is carried by the carrying mechanism, a controller that receives a signal that is output from the contact sensor, and a memory that stores measurement data of a time from when the contact sensor and the medium enter a non-contact state until a signal that is output from the contact sensor and that indicates that the medium is not being detected is received by the controller.

===Overview of Printing Apparatus===

An embodiment of a printing apparatus according to the present invention is described with an inkjet printer as an example.

Figure 2:
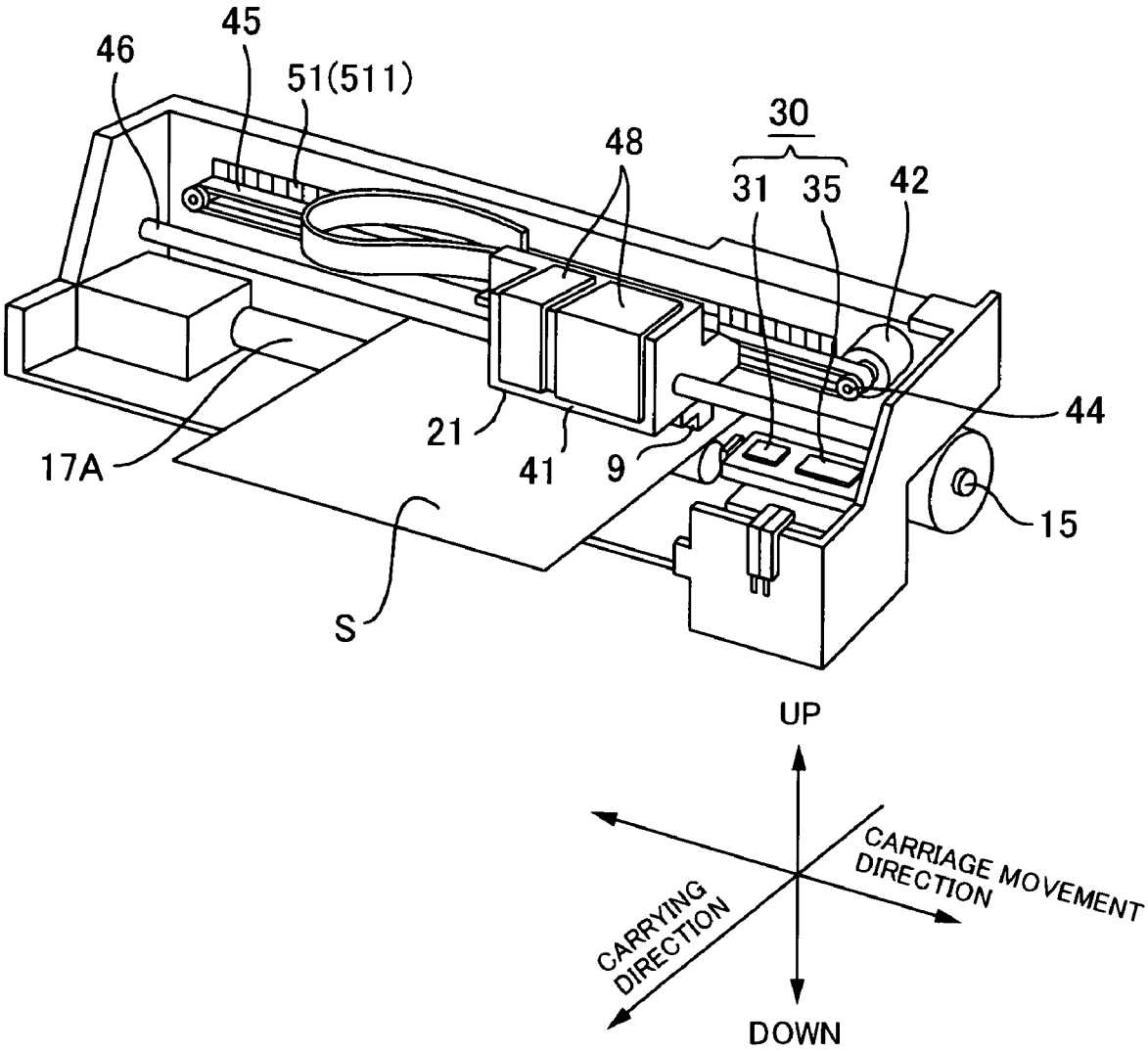
FIG. 2 is a perspective view that describes the internal structure of the printing apparatus.
Figure 3:
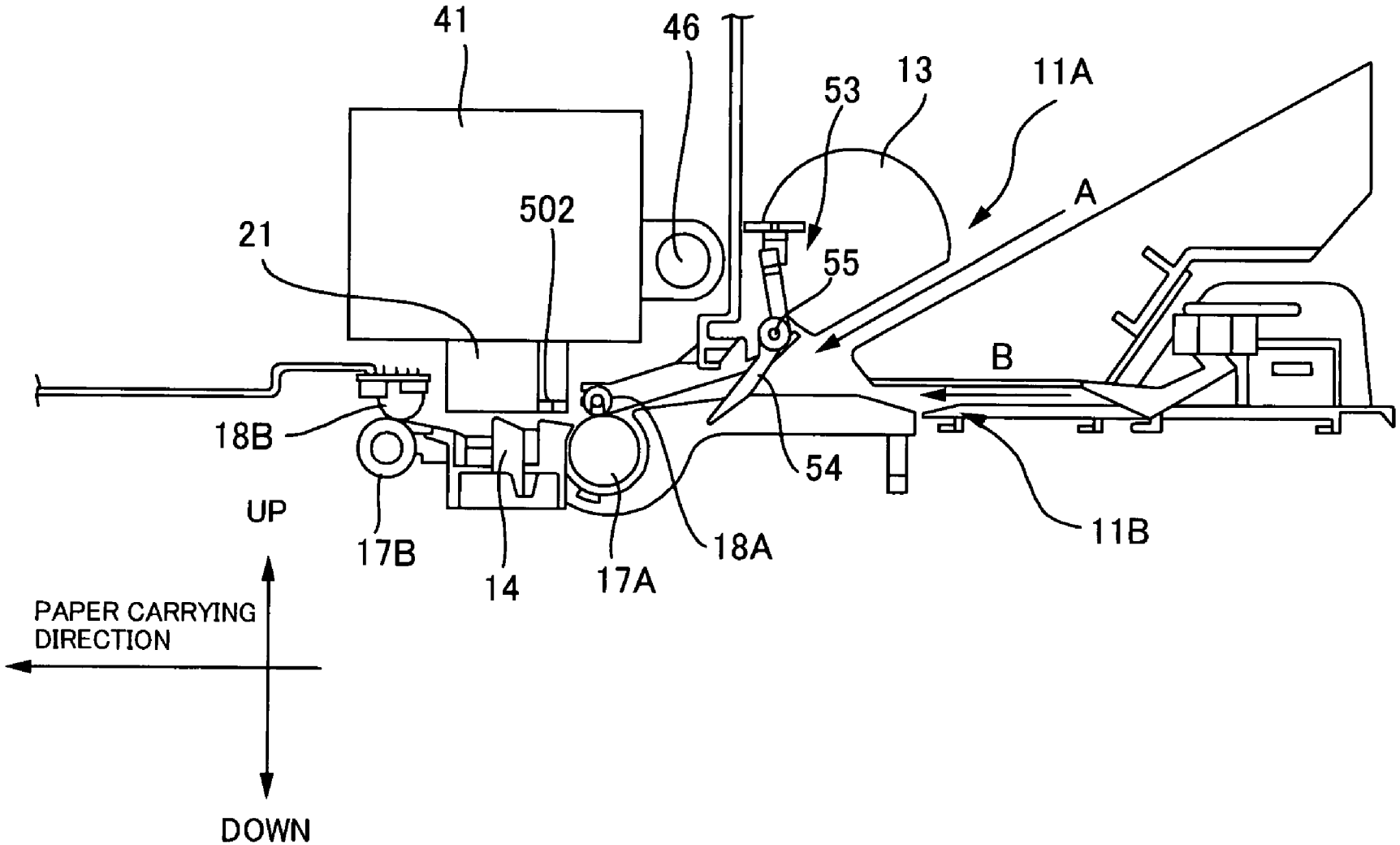
FIG. 3 is a cross sectional view illustrating a carrying section of the printing apparatus.
Figure 4:
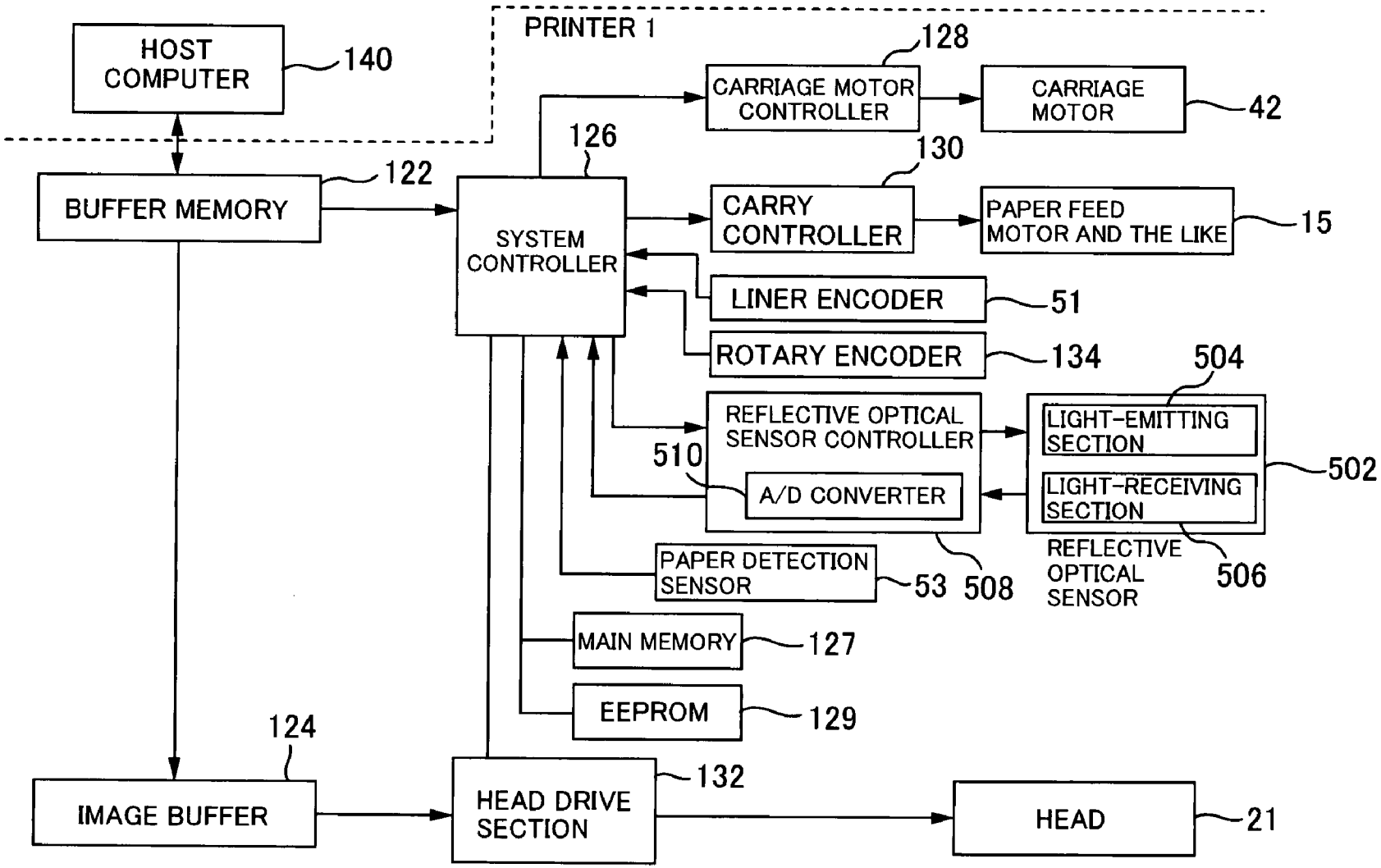
FIG. 4 is a block diagram illustrating a system configuration of the printing apparatus.

FIGS. 1 to 4 show an inkjet printer 1. FIG. 1 illustrates an exterior view of the inkjet printer 1. FIG. 2 illustrates the internal configuration of the inkjet printer 1. FIG. 3 shows the carrying section of the inkjet printer 1. FIG. 4 is a block diagram showing the system configuration of the inkjet printer 1.

As shown in FIG. 1, the inkjet printer 1 is provided with a structure in which a medium such as a print paper that is supplied from the rear side is discharged from the front side. A control panel 2 and a paper discharge section 3 are arranged at the front side portion, and a paper supply section 4 is provided at the rear side portion. The control panel 2 is provided with various types of control buttons 5 and display lamps 6. The paper discharge section 3 is provided with a paper discharge tray 7 that blocks the paper discharge opening when the inkjet printer is not in use. A paper supply tray 8 is arranged at the paper supply section 4 to hold cut paper (not shown). It should be noted that the inkjet printer 1 can also be provided with a paper feed structure that is capable of being used in printing not only print paper in single sheets, such as cut paper, but also media that are continuous, such as roll paper.

As shown in FIG. 2, a carriage 41 is arranged inside the inkjet printer 1. The carriage 41 is arranged such that it can move relatively along a predetermined direction (a sideways direction in the drawing). A carriage motor (hereafter also referred to as "CR motor") 42, a pulley 44, a timing belt 45, and a guide rail 46 are provided in the vicinity of the carriage 41. The carriage motor 42 is constituted by a DC motor or the like and functions as a driving source for moving the carriage 41 relatively along the predetermined direction. Furthermore, the timing belt 45 is connected to the carriage motor 42 via the pulley 44 and a portion of it is also connected with the carriage 41, such that the carriage 41 is moved relatively along the predetermined direction by the rotational drive of the carriage motor 42. The guide rail 46 guides the carriage 41 along the predetermined direction.

In addition to these, also provided in the vicinity of the carriage 41 are a linear encoder 51 that detects a position of the carriage 41, a carry roller 17A for carrying a medium S along a direction perpendicular to the movement direction of the carriage 41, and a paper feed motor 15 that rotationally drives the carry roller 17A.

On the other hand, ink cartridges 48 that store the various inks and a head 21 that carries out printing on the medium S are arranged at the carriage 41. The ink cartridges 48 store color inks such as yellow (Y), magenta (M), cyan (C), and black (K) for example, and are mounted in a cartridge mounting portion provided in the carriage 41 in a removable manner. Furthermore, in this embodiment, the head 21 carries out printing by ejecting ink onto the medium S. For this reason, multiple nozzles for ejecting ink are provided in the head 21. Detailed description of the ink ejecting mechanism of the head 21 is given later.

Additionally, a cleaning unit 30 for clearing clogging of the nozzles of the head 21 is arranged inside the inkjet printer 1. The cleaning unit 30 has a pump device 31 and a capping device 35. The pump device 31 is a device to suck out ink from the nozzles in order to clear clogging of the nozzles of the head 21, and it is operated by a pump motor (not shown). On the other hand, the capping device 35 is for sealing the nozzles of the head 21 when printing is not being performed (such as during standby) in order to prevent the nozzles of the head 21 from clogging.

The following is a description concerning the configuration of the carrying section of the inkjet printer 1. As shown in FIG. 3, the carrying section has a paper insert opening 11A and a roll paper insert opening 11B, a paper supply motor (not shown), a paper supply roller 13, a platen 14, a paper feed motor (hereinafter, also referred to as PF motor) 15, a carry roller 17A and a paper discharge roller 17B, and a free roller 18A and a free roller 18B. Of these, the paper feed motor 15, the carry roller 17A, and the paper discharge roller 17B constitute the carrying mechanism in the present invention.

The paper insert opening 11A is where the medium S is to be inserted. The paper supply motor (not shown) is a motor for carrying the medium S that has been inserted into the paper insert opening 11A into the inkjet printer 1, and is constituted by a pulse motor or the like. The paper supply roller 13 is a roller for automatically carrying the medium S that has been inserted into the paper insert opening 11A into the inkjet printer 1 in the direction shown by arrow A in the drawing (in the direction shown by arrow B in the case of roll paper), and is driven by the paper supply motor. The paper supply roller 13 has a transverse cross-sectional shape that is substantially the shape of the letter D. The circumferential length of the outer peripheral portion of the paper supply roller 13 is set longer than the carrying distance to the paper feed motor 15, so that using this outer peripheral portion, the medium S can be carried up to the paper feed motor 15.

The medium S carried by the paper supply roller 13 comes into contact with a paper detection sensor 53. The paper detection sensor 53 is arranged between the paper supply roller 13 and the carry roller 17A, and therefore is configured so as to detect the medium S supplied by the paper supply roller 13. The paper detection sensor 53 is provided with a lever 54 that contacts the medium S and, when the lever 54 rotates about a shaft 55 due to contact with the medium S, the paper detection sensor is made to output a signal notifying that the medium S has been detected. Furthermore, the lever 54 rotates so as to return to its original position when it separates from the medium S. At this time, the paper detection sensor 53 is made to output a signal notifying that the medium S is not being detected.

The medium S detected by the paper detection sensor 53 is carried to the platen 14. The platen 14 is a support means that supports the medium S during printing. The paper feed motor 15 is a motor for feeding paper, which is an example of a medium S, in the paper carrying direction, and is constituted by a DC motor. The carry roller 17A is a roller for feeding the medium S that has been carried into the inkjet printer 1 by the paper supply roller 13 to a printable region, and is driven by the paper feed motor 15. The free roller 18A is provided in a position that is in opposition to the carry roller 17A, and pushes the medium S toward the carry roller 17A by sandwiching the medium S between itself and the carry roller 17A.

The paper discharge roller 17B is a roller for discharging the medium S to which printing has finished to outside the inkjet printer 1. The paper discharge roller 17B is driven by the paper feed motor 15 through a gear wheel that is not shown in the drawings. The free roller 18B is provided in a position that is in opposition to the paper discharge roller 17B, and pushes the medium S toward the paper discharge roller 17B by sandwiching the medium S between itself and the paper discharge roller 17B.

<System Configuration>

The following is a description concerning the system configuration of the inkjet printer 1. As shown in FIG. 4, the inkjet printer 1 is provided with a buffer memory 122, an image buffer 124, a system controller 126, a main memory 127, and an EEPROM 129. The buffer memory 122 receives and temporarily stores various kinds of data such as print data sent from a host computer 140. The image buffer 124 obtains the received print data from the buffer memory 122 and stores it. Furthermore, the main memory 127 is constituted by a ROM and a RAM, and the like. It should be noted that the main memory 127 corresponds to a memory in the present invention.

On the other hand, the system controller 126 reads out a control program from the main memory 127 and carries out the overall control of the inkjet printer 1 in accordance with the control program. The system controller 126 of the present embodiment is provided with a carriage motor controller 128, a carry controller 130, a head drive section 132, a rotary encoder 134, and a linear encoder 51. The carriage motor controller 128 performs drive control of carriage motor 42 for such aspects as rotational direction, number of rotations, torque and the like. Furthermore, the head drive section 132 performs drive control of the head 21. The carry controller 130 controls the various drive motors that are arranged in the carry system, such as the paper feed motor 15 that rotatively drives the carry roller 17A.

Print data that have been transferred from the host computer 140 are temporarily held in the buffer memory 122. Necessary information contained in the print data held here is read out by the system controller 126. Based on the information that is read out, the system controller 126 controls the carriage motor controller 128, the carry controller 130, and the head drive section 132 in accordance with a control program while referencing output from the linear encoder 51 and the rotary encoder 134.

Print data for a plurality of color components received by the buffer memory 122 is stored in the image buffer 124. The head drive section 132 obtains the print data of the various color components from the image buffer 124 in accordance with control signals from the system controller 126, and drives the various color nozzles provided in the head 21 based on the print data.

Furthermore, a signal that is output from the paper detection sensor 53 and indicates whether or not the medium S is being detected is input to the system controller 126. Thus, the system controller 126 is capable of discerning whether or not the paper detection sensor 53 is detecting the medium S.

It should be noted that, in addition to these, the inkjet printer 1 according to the present embodiment is provided with a reflective optical sensor 502 and a reflective optical sensor controller 508. The reflective optical sensor 502 and the reflective optical sensor controller 508 will be described in further detail below.

<Head>

Figure 5:
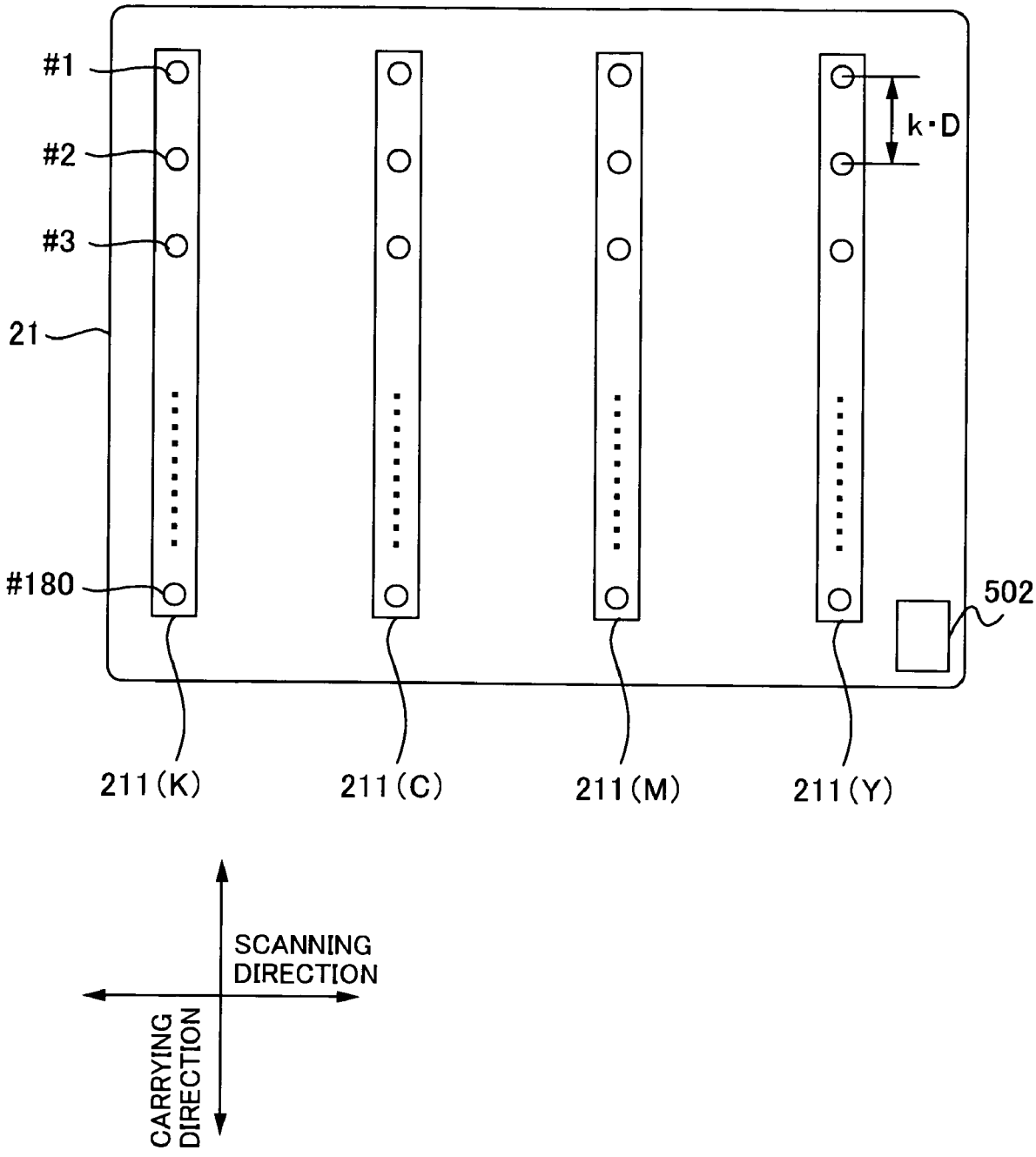
FIG. 5 is a top view showing one example of an ink ejection portion of the printing apparatus.

FIG. 5 illustrates the arrangement of ink nozzles on the lower surface of the head 21. As shown in the diagram, nozzle rows 211, which are made from a plurality of nozzles #1 to #180 for each of the colors of yellow (Y), magenta (M), cyan (C), and black (K) are provided on the lower surface of the head 21. It should be noted that the respective nozzles #1 to #180 of the color nozzle rows 211 of yellow (Y), magenta (M), cyan (C), and black (K) correspond to the print section in the present invention.

The respective nozzles #1 to #180 of the respective nozzle rows 211 are arranged linearly along the carrying direction of the mediums. The respective nozzle rows 211 are positioned in parallel with spaces between the rows along the movement direction (carriage movement direction) of the head 21. Each nozzle #1 to #180 is provided with a piezo element (not shown) as a drive element for ejecting ink droplets.

When a voltage of a predetermined duration is applied between electrodes provided at both ends of the piezo elements, the piezo elements expand for the duration of voltage application and deform a lateral wall of the ink channel. As a result, the volume of the ink channel is constricted by an amount according to the expansion of the piezo element, and ink corresponding to this amount of constriction is ejected from each nozzle #1 to #180 of each color as an ink droplet.

===Rotary Encoder===

The following is a description of the structure of the rotary encoder.

Figure 6:
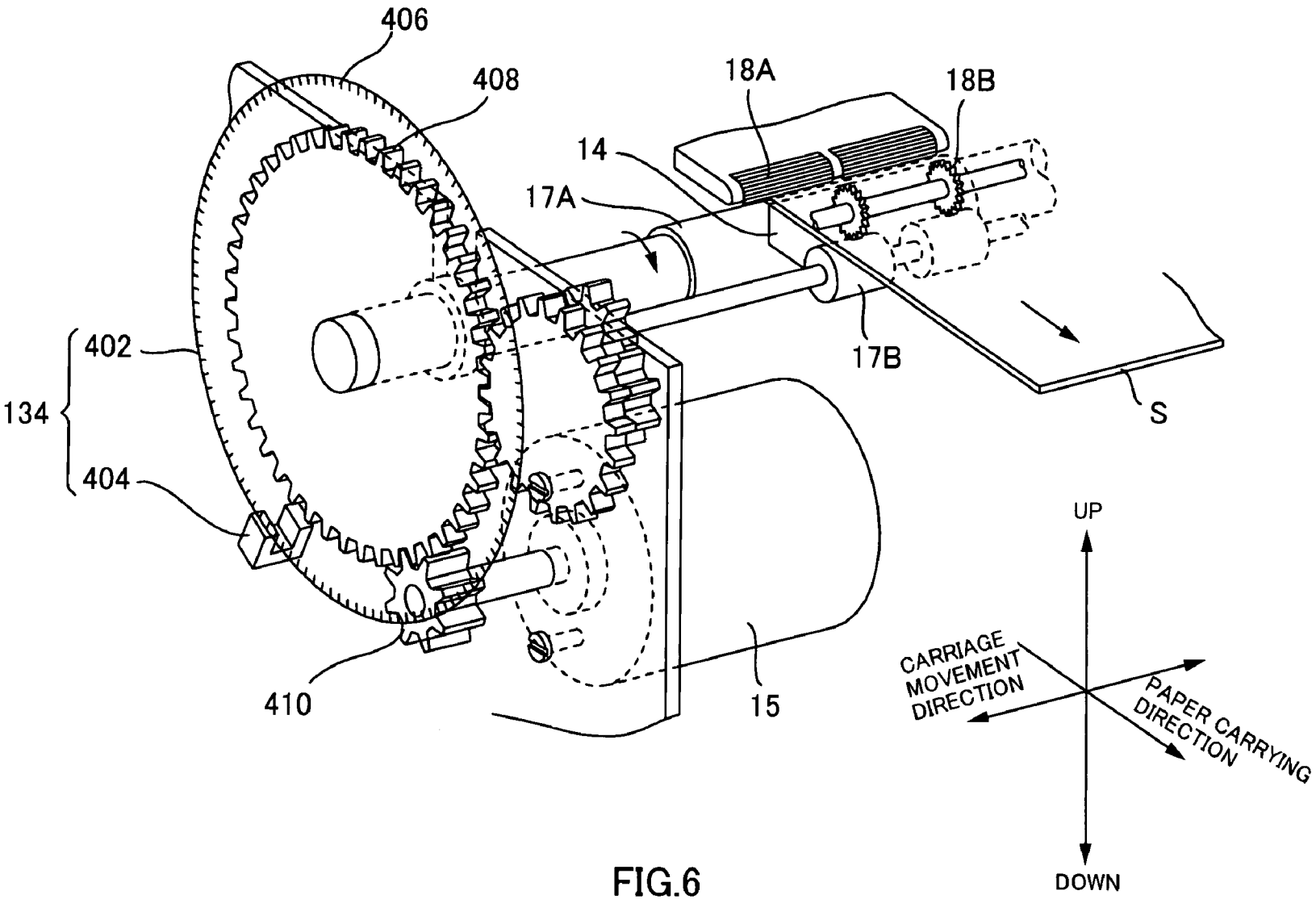
FIG. 6 is an explanatory diagram for describing one example of a rotary encoder.

FIG. 6 is an explanatory diagram for describing the structure of the rotary encoder 134. The rotary encoder 134 is provided with a rotary encoder code plate 402 and a detection section 404 arranged adjacent to the rotary encoder code plate 402.

As shown in the drawing, the rotary encoder code plate 402 is formed as a disk-shape. Multiple minute slits 406 are formed with a predetermined spacing at the outer periphery of the rotary encoder code plate 402. The rotary encoder code plate 402 is integrally provided adjacent to a gear wheel 408 that is integrally provided at a shaft end of the carry roller 17A which carries the medium S. The gear wheel 408 is connected to the paper feed motor 15 via a pinion 410 and rotates via the pinion 410 by the rotational drive of the paper feed motor 15. In this way, the carry roller 17A rotates by the rotational drive of the paper feed motor 15, and the rotary encoder code plate 402 also rotates in synchronization with the gear wheel 408 and the carry roller 17A.

<Regarding the Configuration of the Detection Section 404>

FIG. 7 is a diagram for illustrating in detail the configuration of the detection section 404 of the rotary encoder 134. The detection section 404 is provided with a light-emitting diode 412, a collimator lens 414, and a detection processing section 416. The detection processing section 416 has a plurality of (for instance, four) photodiodes 418, a signal processing circuit 420, and for example two comparators 422A and 422B.

The light-emitting diode 412 emits light when a voltage Vcc is applied to it via resistors on both sides. This light is condensed into parallel light by the collimating lens 414 and passes through the rotary encoder code plate 402. The rotary encoder code plate 402 is provided with the slits 406 at a predetermined spacing (for example, 1/180 inch (one inch=2.54 cm)).

The parallel light that passes through the rotary encoder code plate 402 then passes through stationary slits (not shown) and is incident onto the respective photodiodes 418, where it is converted into electrical signals. The electrical signals that are output from the four photodiodes 418 are subjected to signal processing in the signal processing circuit 420, and the signals that are output from the signal processing circuit 420 are compared in the comparators 422A and 422B, and the results of the comparisons are output as pulses. A pulse ENC-A and pulse ENC-B that are output from the comparators 422A and 422B become the output signals of the rotary encoder 134.

FIGS. 8A and 8B are timing charts that illustrate the waveforms of the two output signals of the rotary encoder 134 when the paper feed motor 15 is rotating forward, and when it is rotating in reverse. FIG. 8A is a timing chart of the waveforms of the output signals when the paper feed motor 15 is rotating forward. FIG. 8B is a timing chart of the waveforms of the output signals when the paper feed motor 15 is rotating in reverse.

As shown in FIGS. 8A and 8B, the phases of the pulse ENC-A and the pulse ENC-B are misaligned by 90 degrees both when the paper feed motor 15 is rotating forward and when it is rotating in reverse. When the paper feed motor 15 is rotating forward, that is, when the medium S is carried in the carrying direction as shown in FIG. 7, then the phase of the pulse ENC-A leads the phase of the pulse ENC-B by 90 degrees. On the other hand, when the paper feed motor 15 is rotating in reverse, that is, when the medium S is carried in the direction opposite the carrying direction, then the phase of the pulse ENC-A is delayed by 90 degrees with respect to the phase of the pulse ENC-B. One period T of each pulse is the same as the time during which the carry roller 17A is rotated by the spacing of the slits 406 of the rotary encoder code plate 402 (for example, by 1/1440 inch (1 inch equals 2.54 cm)).

Then, the rising edges of the output pulses ENC-A and ENC-B of the rotary encoder 134 are detected by the system controller 126, and by counting the number of detected edges, the system controller 126 is able to calculate the rotational position of the paper feed motor 15 based on the counted value. With respect to the counting, when the paper feed motor 15 is rotating forward a "+1" is added for each detected edge, and when it is rotating in reverse a "−1" is added for each detected edge. The respective period of the pulses ENC-A and ENC-B is equal to the time from when a given slit 406 of the rotary encoder code plate 402 passes through the detection section 404 to when the next slit 406 passes through the detection section 404, and the phases of the pulse ENC-A and the pulse ENC-B are misaligned by 90 degrees. Accordingly, a count number of "1" of the counting corresponds to ¼ of the spacing of slits 406 of the rotary encoder code plate 402. Therefore, if the above counted value is multiplied by ¼ of the spacing of the slits 406, then based on this product, the carry amount of the paper feed motor 15 from the rotational position corresponding to the counted value "0" can be obtained. The resolution of the rotary encoder 134 at this time is ¼ of the spacing of the slits 406 of the rotary encoder code plate 402.

===Printing Operation===

Figure 9:
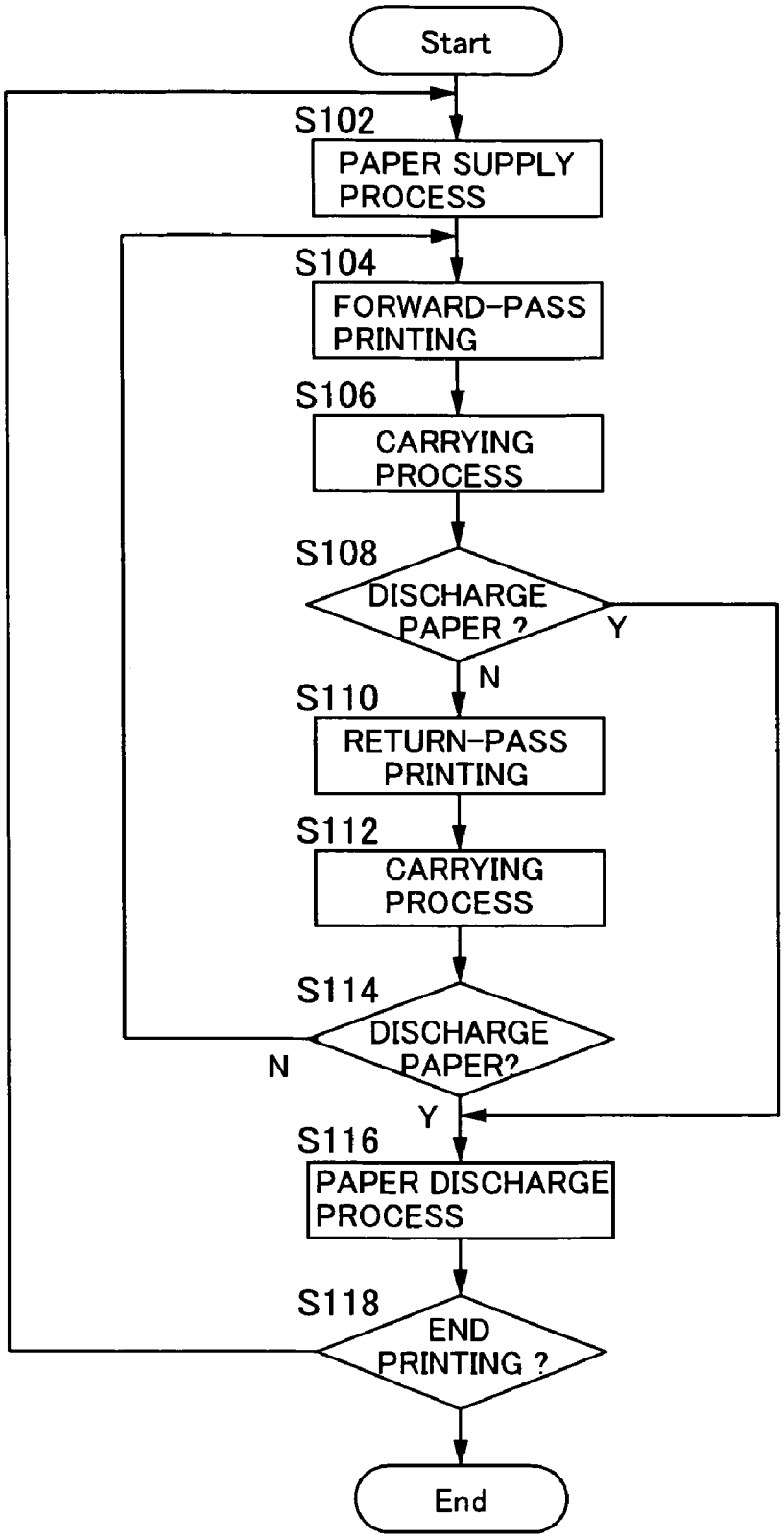
FIG. 9 is a flowchart for describing an example of a printing process.

The following is a description concerning a printing operation of the above-described inkjet printer 1. Here, description will be given using "bi-directional printing" as an example. FIG. 9 is a flowchart showing an example of a processing procedure for a printing operation of the inkjet printer 1. The respective operations that are described below are achieved by the system controller 126 reading out a program stored in the main memory 127 or the EEPROM 129 and controlling the respective units in accordance with the program.

When the system controller 126 receives print data from the host computer 140, first it carries out a paper supply process (S102) in order to execute printing based on that print data. The paper supply process is a process for supplying the medium S to be printed into the inkjet printer 1 and carrying it to a print start position (also referred to as "indexing position"). The system controller 126 rotates the paper supply roller 13 to feed the medium S to be printed to the carry roller 17A. The system controller 126 rotates the carry roller 17A to position the medium S fed by the paper supply roller 13 at the print start position.

Next, the system controller 126 moves the carriage 41 relative to the medium S and carries out a printing process by printing on the medium S. Here, forward-pass printing (S104) is carried out first by ejecting ink from the head while moving the carriage 41 in one direction along the guide rail 46. The system controller 126 moves the carriage 41 by driving the carriage motor 42 and ejects ink by driving the head based on the print data. The ink ejected from the head 21 reaches the medium S and forms dots.

Next, after carrying out printing in this way, a carrying process (S106) is carried out in which the medium S is carried by a predetermined amount. In the carrying process, the system controller 126 carries the medium S by a predetermined amount in the carrying direction relative to the head 21 by driving the paper feed motor 15 to rotate the carry roller 17A. By this carrying process, the head 21 is able to carry out printing in a region different from the region that has just been printed.

After carrying out the carrying process in this way, a paper discharge judgment (S108) is made as to whether or not the paper is to be discharged. Here, if there is no other data for which printing should be carried out on the medium S being printed, a paper discharge process (S116) is executed. On the other hand, if there is other data which is to be printed on the medium S being printed, return-pass printing (S110) is carried out without executing a paper discharge process. This return-pass printing is carried out while moving the carriage 41 along the guide rail 46 in a direction opposite to that of the forward-pass printing that has just been performed. Here also, the system controller 126 executes printing by rotatively driving the carriage motor 42 in a reverse direction to a previous rotating direction and moving the carriage 41, and driving the head 21 based on the print data to eject ink.

After return-pass printing is carried out, a carrying process (S112) is carried out, after which a paper discharge judgment (S114) is performed. Here, if there is other data which is to be printed on the medium S being printed, the procedure returns to step S104 without carrying out a paper discharge process, and forward-pass printing (S104) is carried out once more. On the other hand, if there is no other data which is to be printed on the medium S being printed, a paper discharge process (S116) is executed.

Next, after the paper discharge process is carried out, a print completion judgment (S118) is made in which it is judged whether or not to end printing. Here, next based on the print data from the host computer 140, it is checked whether or not there is a medium S to be printed next. If there is a medium S to be printed next, the procedure returns to step S102 and a paper supply process is executed again to begin printing. On the other hand, if there is no medium S to be printed next, the printing processing is finished.

===Reflective Optical Sensor ===

The inkjet printer 1 according to the present embodiment is provided with the reflective optical sensor 502. It should be noted that the reflective optical sensor 502 corresponds to the non-contact sensor in the present invention.

<Reflective Optical Sensor>

Figure 10:
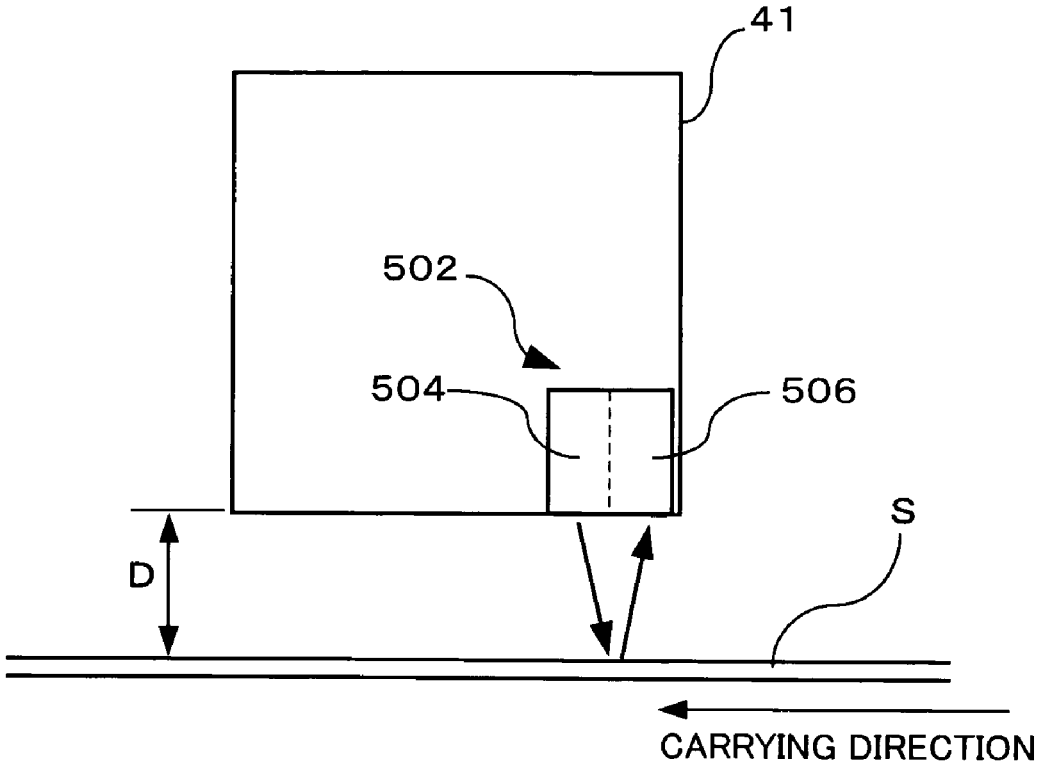
FIG. 10 is an explanatory diagram showing a reflective optical sensor.

FIG. 10 shows the reflective optical sensor 502. As shown in the drawing, the reflective optical sensor 502 is integrally provided at the carriage 41, and as shown in FIG. 5, is arranged along with the nozzle rows 211 at the lower surface portion of the head 21. The reflective optical sensor 502 is provided with a light-emitting section 504 and a light-receiving section 506, and is arranged with a spacing D apart from the medium S. The spacing D is set to, for example, 5 mm or the like. The light-emitting section 504 and the light-receiving section 506 are respectively arranged in opposition to the medium S. The light-emitting section 504 is constituted by a light-emitting diode for example that emits light toward the medium S. The light-receiving section 506 is constituted by a photodiode and the like, which receives the light that is emitted from the light-emitting section 504 and reflected by the medium S.

Components of the light received by the light-receiving section 506 include a regular reflection component of light that is emitted from the light-emitting section 504 and reflected by the medium S. The light-receiving section 506 is arranged in a position capable of receiving the regular reflection component.

The light-receiving section 506 generates a signal that corresponds to the intensity of the received light. The signal generated by the light-receiving section 506 is output externally as a detection result from the reflective optical sensor 502. As shown in FIG. 4, the signal output from the reflective optical sensor 502 is input to the reflective optical sensor controller 508.

<Reflective Optical Sensor Controller>

The reflective optical sensor controller 508 is provided with the function of controlling the reflective optical sensor 502 in accordance with commands from the system controller 126. That is, the reflective optical sensor controller 508 is configured such that, based on commands from the system controller 126, it causes the light-emitting section 504 of the reflective optical sensor 502 to emit light, stops the emission of light, and adjusts the light-receiving sensitivity or the like of the light-receiving section 506 of the reflective optical sensor 502.

In addition to this, the reflective optical sensor controller 508 of the present embodiment is provided with an A/D converter 510 and has the function of converting the signals output from the light-receiving section 506 of the reflective optical sensor 502 from analog signals to digital signals by the A/D converter 510. Specifically, the reflective optical sensor controller 508 is configured so as to use A/D conversion to convert the signals output from the reflective optical sensor 502 to digital signals, and to output these to the system controller 126 as digital data.

<System Controller>

The system controller 126 obtains the detection results of the light-receiving section 506 of the reflective optical sensor 502 from the reflective optical sensor controller 508 as digital data. Then, based on the obtained digital data and the positional information of the carriage 41 obtained from the linear encoder 51, the system controller 126 detects the position of the medium S for which printing is to be conducted.

===Paper Detection Sensor===

The following is a description concerning the paper detection sensor 53 provided in the inkjet printer 1 according to the present embodiment. It should be noted that the paper detection sensor 53 corresponds to the contact sensor in the present invention.

Figure 11A:
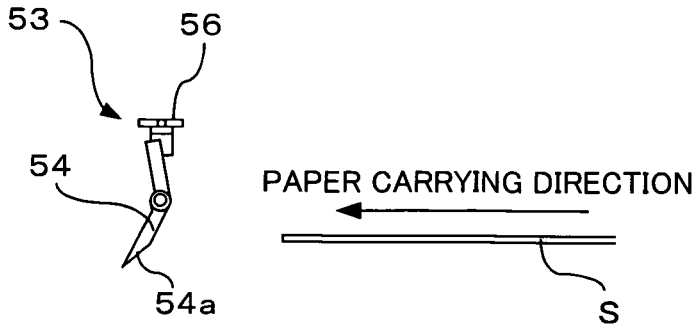
FIGS. 11A to 11D are explanatory diagrams for describing conditions when a paper detection sensor detects the medium.
Figure 11B:
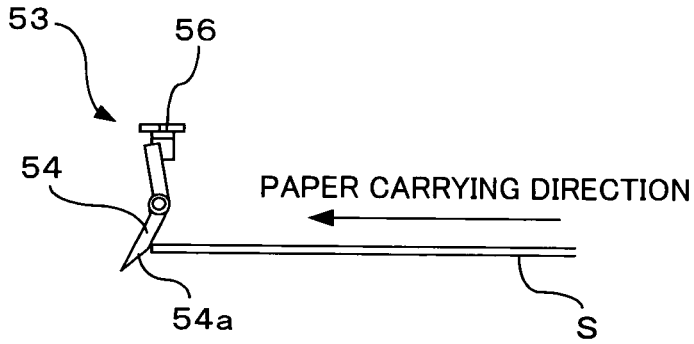
Figure 11C:
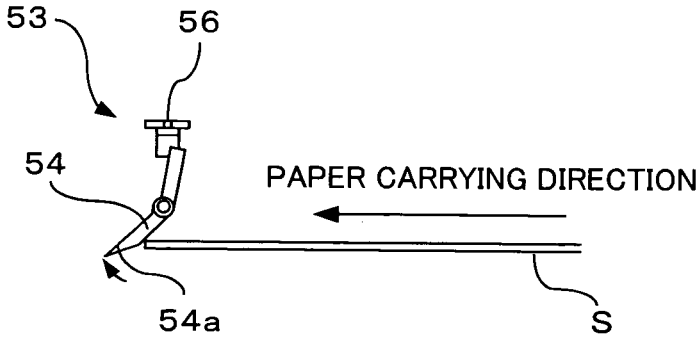

FIGS. 11A to 11D schematically illustrate the operational conditions when the paper detection sensor 53 of the present embodiment contacts the medium S and detects the medium S. As shown in FIG. 11A, the paper detection sensor 53 is arranged in a forward area of the carry path of the medium S so as to detect the medium S that is carried in. When the medium S approaches the paper detection sensor 53, first, as shown in FIG. 11B the front end of the medium S contacts the paper detection sensor 53. Here, the front end of the medium S makes contact with the lever 54 arranged rotatably at the paper detection sensor 53. When the front end of the medium S makes contact with the lever 54 of the paper detection sensor 53, as the medium S is carried, the lever 54 is gradually raised as shown in FIG. 11C.

Figure 11D:
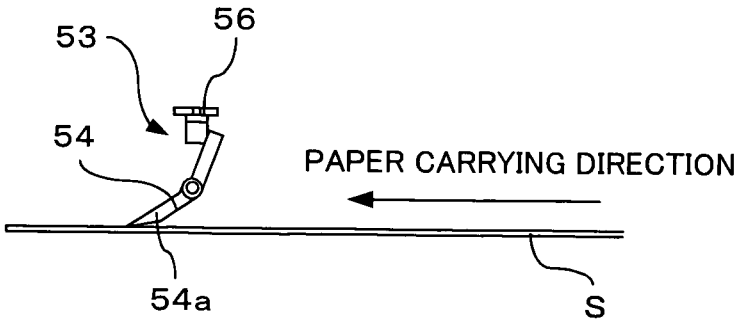

When the lever 54 is raised to a predetermined angle θ, the positions of the upper end portion of the lever 54 and a detection section 56 arranged in the vicinity of the upper end portion become displaced such that the raising of the lever 54 is detected by the detection section 56. At this time, a signal (hereinafter, also referred to as "media detection signal") indicating that the medium S has been detected is output to the system controller 126 from the paper detection sensor 53. After the front end of the medium S has passed through the paper detection sensor 53, the lever 54 stays in a raised state in contact with the medium S as shown in FIG. 11D, and the media detection signal is continually output from the paper detection sensor 53.

Figure 12A:
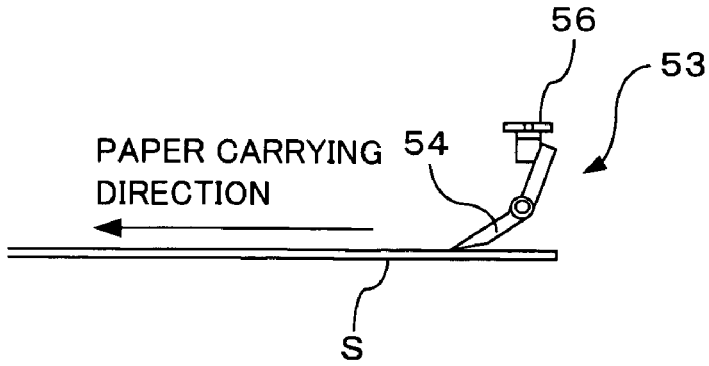
FIGS. 12A to 12D are explanatory diagrams for describing conditions when the paper detection sensor stops detecting the medium.
Figure 12B:
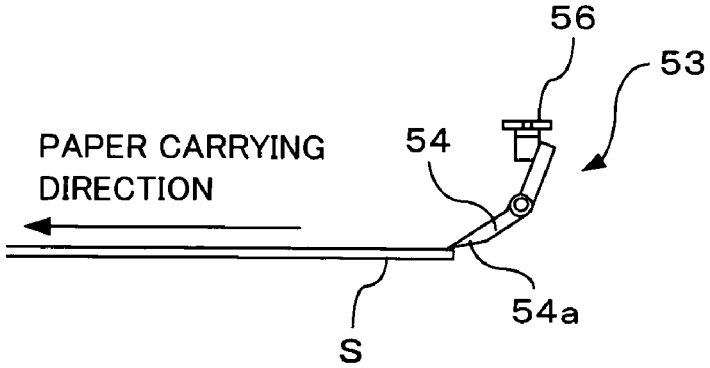
Figure 12C:
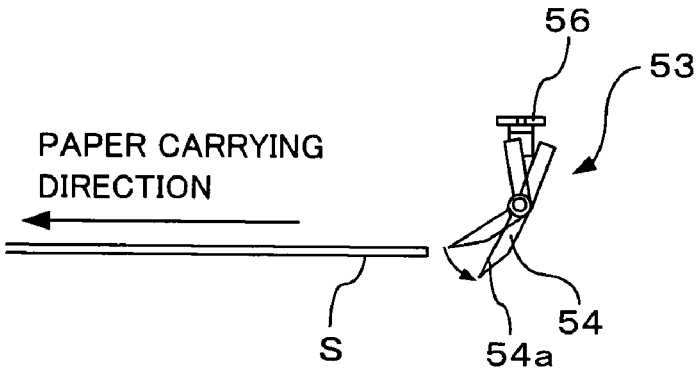
Figure 12D:
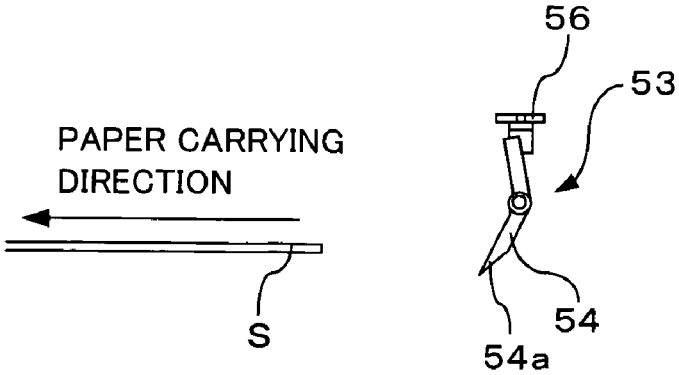

FIGS. 12A to 12D schematically illustrate the operational conditions when the paper detection sensor 53 of the present embodiment separates from the medium S and goes into a non-contact state. As shown in FIG. 12A, as the medium S is gradually carried, the rear end portion of the medium S gradually approaches the paper detection sensor 53. Then, after the rear end portion of the medium S reaches a tip end portion 54*a* of the lever 54 of the paper detection sensor 53 as shown in FIG. 12B, when the medium S is carried further, the rear end portion of the medium S separates from the lever 54. When the medium S separates from the lever 54 in this way, the force that had raised the lever 54 from below is eliminated, and the lever 54 begins to drop naturally, as shown in FIG. 12C. As shown in FIG. 12D, when the lever 54 drops up to the predetermined angle θ, the upper end portion of the lever 54 and the detection section 56 once again overlap. In this way, the separation of the lever 54 from the medium S is detected by the detection section 56. At this time, a signal (hereinafter, also referred to as "media non-detection signal") indicating that the medium S is not being detected is output from the paper detection sensor 53 to the system controller 126. The lever 54 continues to drop until it returns to a position when it is not in contact with the medium S, that is, its original position.

Figure 13:
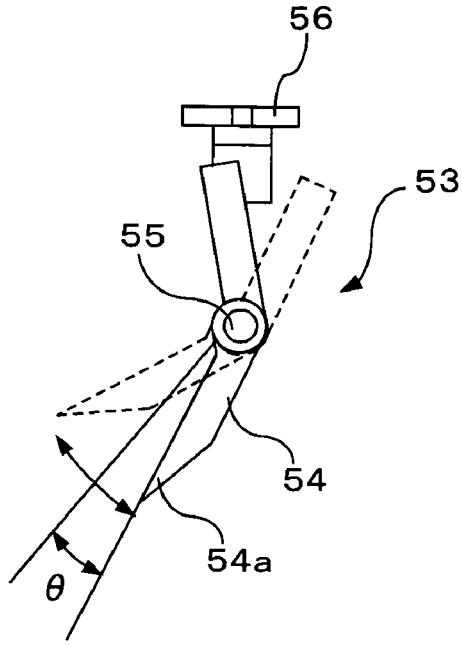
FIG. 13 is an explanatory diagram for describing the operational conditions of the paper detection sensor.

FIG. 13 is an explanatory diagram for illustrating the operational condition of the paper detection sensor 53. As shown in this drawing, with the paper detection sensor 53, contact between the lever 54 and the medium S is not detected in the detection section 56 above the lever 54, unless the lever 54 is raised to the predetermined angle θ after contacting the medium S. Furthermore, separation of the lever 54 from the medium S is not detected in the detection section 56 unless the lever 54 falls to the predetermined angle θ after it separates from the medium S. That is, there is a short period of time from when the lever 54 contacts the medium S until this contact is detected by the detection section 56, and from when the lever 54 separates from the medium S until this separation is detected by the detection section 56.

Figure 14:
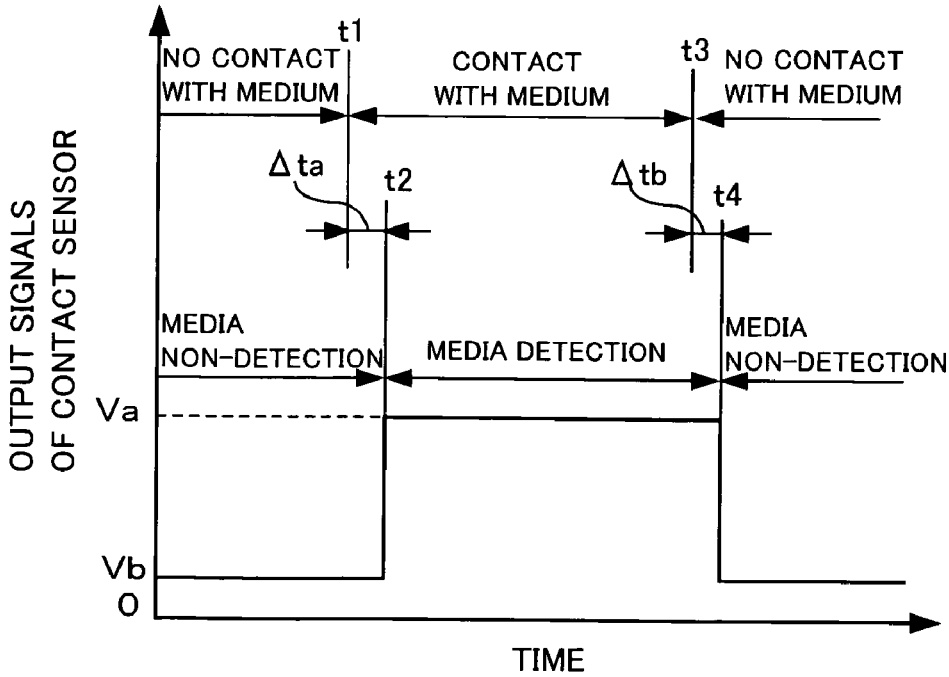
FIG. 14 is an explanatory diagram showing the signals output from the paper detection sensor.

FIG. 14 shows the signals to be output from the paper detection sensor 53. When the lever 54 contacts the medium S and the raising of the lever 54 to the predetermined angle θ is detected by the detection section 56, a signal of a signal level Va is output from the paper detection sensor 53 as the media detection signal. Furthermore, when the lever 54 separates from the medium S and the falling of the lever 54 to the predetermined angle θ is detected by the detection section 56, a signal of a signal level Vb is output from the paper detection sensor 53 as the media non-detection signal. There is a short time difference Δta between a timing t1 when the lever 54 and the medium S actually contact and a timing t2 when the media detection signal starts to be output from the paper detection sensor 53. Furthermore, there is a short time difference Δtb between a timing t3 when the lever 54 and the medium S actually separate and a timing t4 when the media non-detection signal starts to be output from the paper detection sensor 53.

===Point at Issue===

With the paper detection sensor 53, since there is a slight time difference Δt2 from when the lever 54 separates from the medium until the signal indicating that the medium S is not being detected is output, it has been extremely difficult to obtain the correct timing when the paper detection sensor 53 and the medium S actually entered a non-contact state. In particular, since the time difference Δt2 is different among individual sensors even for the same type of paper detection sensor 53 due to the installed position of the paper detection sensor 53, manufacturing error, and the like, it has been extremely difficult to estimate the correct timing at which the paper detection sensor 53 and the medium S enter a non-contact state.

Since it has not been possible to obtain the timing that the lever 54 and the medium S entered a non-contact state, it has not been possible to discern the timing by which the paper detection sensor 53 and the medium S entered a non-contact state when attempting to detect the position of the medium S after the lever 54 has separated from the medium S, and therefore it has been extremely difficult to determine the correct position of the medium S. Thus, it has been extremely difficult to determine the position of the rear end portion of the medium S when, for example, carrying the medium S slowly so as to ensure the rear end portion does not rise up at the time the rear end portion of the medium S passes through the carry roller 17A, and when executing "borderless printing" in which printing is carried out to the very end of the rear end portion of the medium S. For this reason, inconveniences have occurred, such as extra time being taken in processing, which incurs reduction in printing speed, and extra ink having to be ejected.

===Measurement Data===

Thus, with the inkjet printer 1 according to the present embodiment, measurement data of the time differences from when the lever 54 separates from the medium S, that is, from when the lever 54 and the medium S enter a non-contact state, until the media non-detection signal output from the paper detection sensor 53 is received by the system controller 126 is stored in the main memory 127. This measurement data is data obtained by measuring these time differences for each printer individually. The method for obtaining that measurement data is described in detail below.

<Method for Obtaining Measurement Data>

Figure 15:
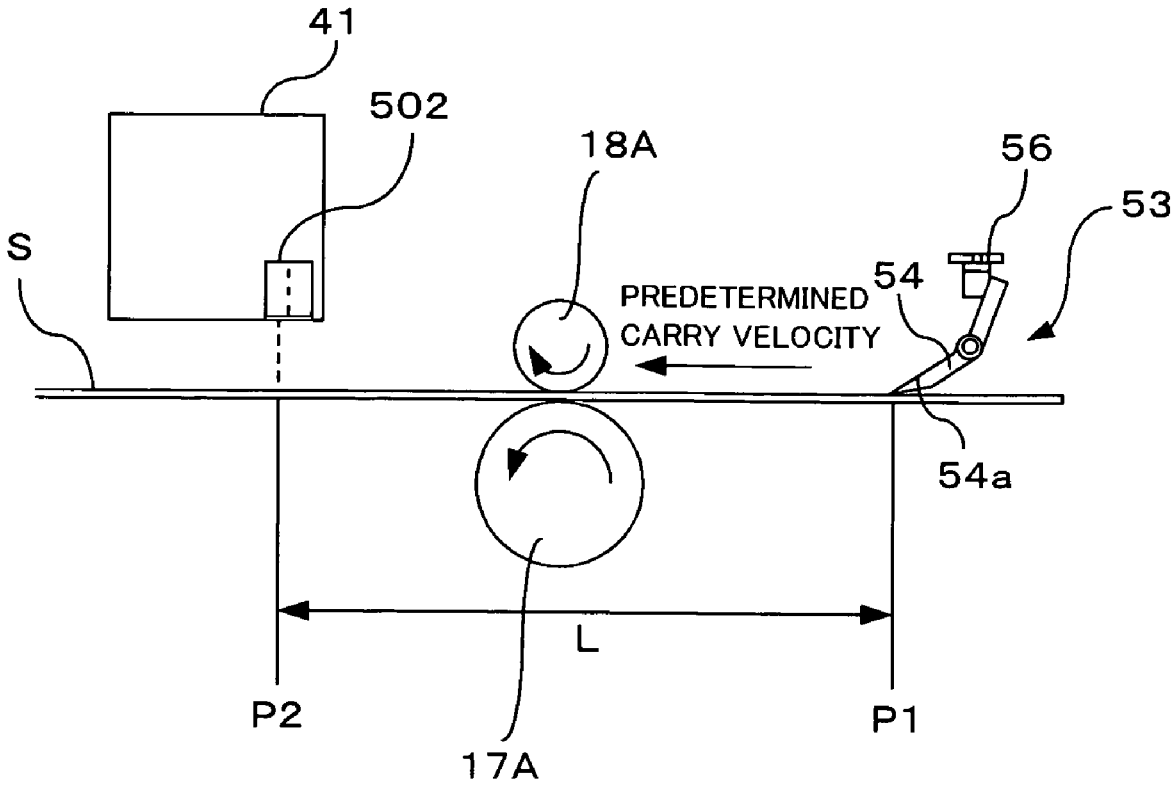
FIG. 15 is an explanatory diagram for describing a method to obtain measurement data.

FIG. 15 illustrates a method for obtaining measurement data in the inkjet printer 1 according to the present embodiment. Here, the reflective optical sensor 502 provided on the carriage 41 is used to obtain the measurement data. The medium S is carried at a predetermined carry velocity by the carry roller 17A. At this time, the elapsed time from when the media non-detection signal output from the paper detection sensor 53 is received by the system controller 126, until a signal that is output from the reflective optical sensor 502 and that indicates that the medium is not being detected (hereinafter, also referred to as "media non-detection signal") is received by the system controller 126, is measured by the system controller 126. The elapsed time obtained by this measurement is given as "tm".

Furthermore, the time from when the lever 54 of the paper detection sensor 53 and the medium S enter a non-contact state until the media non-detection signal output from the paper detection sensor 53 is received by the system controller 126 is taken to be "Δt0". Furthermore, the distance from a point P1 at which the lever 54 and the medium S separate up to a point P2 at which the medium S is detected by the reflective optical sensor 502 is taken to be "L". Furthermore, if the carry velocity of the medium S is V, then the following equation is established:

$$L=V\times tm+V\times\Delta t0 \quad (1)$$

Here, if the medium S is carried twice at different carry velocities V1 and V2 and respective elapsed times tm1 and tm2 are measured, the following two equations are established:

$$L=V1\times tm1+V1\times\Delta t0 \quad (2)$$

$$L=V2\times tm2+V2\times\Delta t0 \quad (3)$$

When L is omitted from these two Equations (2) and (3), then the following equations can be obtained:

$$\Delta t0=(V1\times tm1-V2\times tm2)/(V2-V1) \quad (4)$$

From this Equation (4), it is possible to obtain the time Δt0 from when the lever 54 of the paper detection sensor 53 and the medium S enter a non-contact state until the media non-detection signal output from the paper detection sensor 53 is received by the system controller 126.

<Procedure for Obtaining Measurement Data>

Figure 16A:
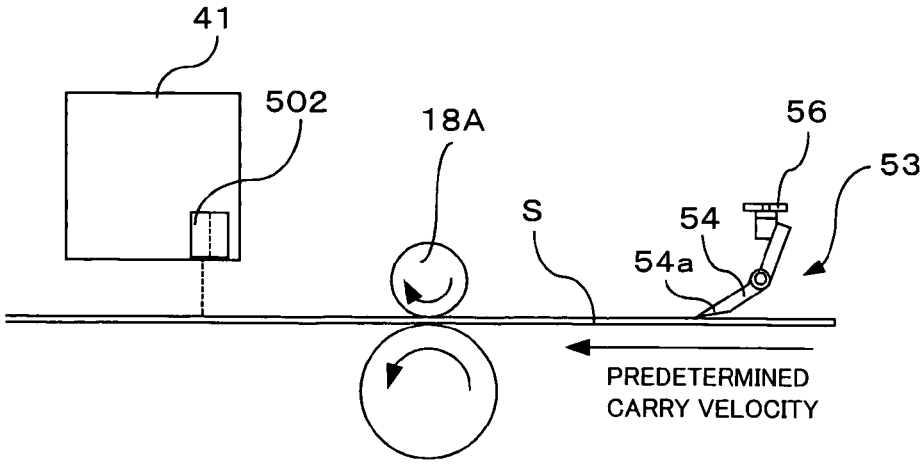
FIGS. 16A to 16C are explanatory diagrams for describing a procedure to obtain measurement data.

FIG. 16 is an explanatory diagram for illustrating an example of a procedure for obtaining the elapsed time tm in the inkjet printer 1 according to the present embodiment. When obtaining the elapsed time tm, first, as shown in FIG. 16A, the carrying of the medium S is started by the carry roller 17A. At this time, the medium S is carried at a predetermined carry velocity V.

Figure 16B:
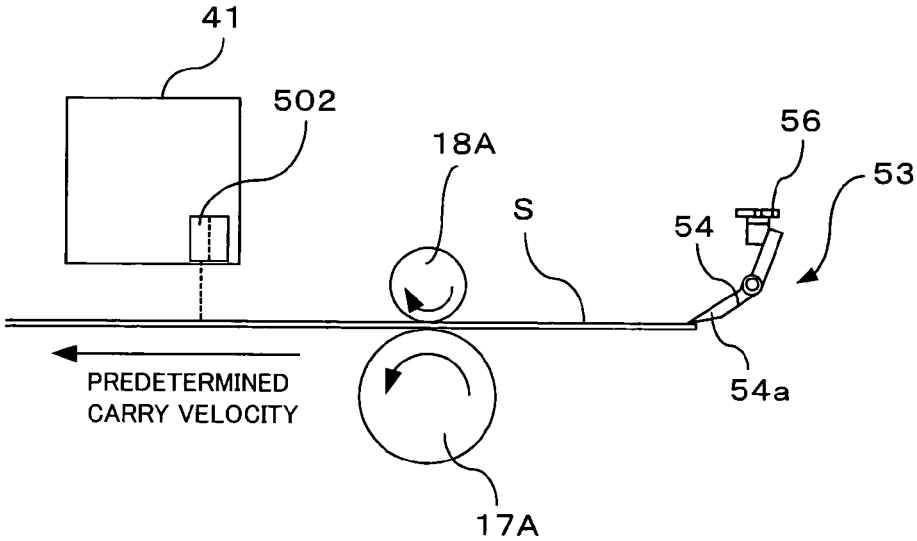

Then, when the rear end portion of the medium S reaches the tip end portion 54*a* of the lever 54 of the paper detection sensor 53 as shown in FIG. 16B, the medium S separates from the lever 54 and the lever 54 begins to fall. After this, a media non-detection signal is output from the paper detection sensor 53 when the lever 54 falls up to the predetermined angle θ. When the media non-detection signal is received by the system controller 126, time measurement is started by the system controller 126.

Figure 16C:
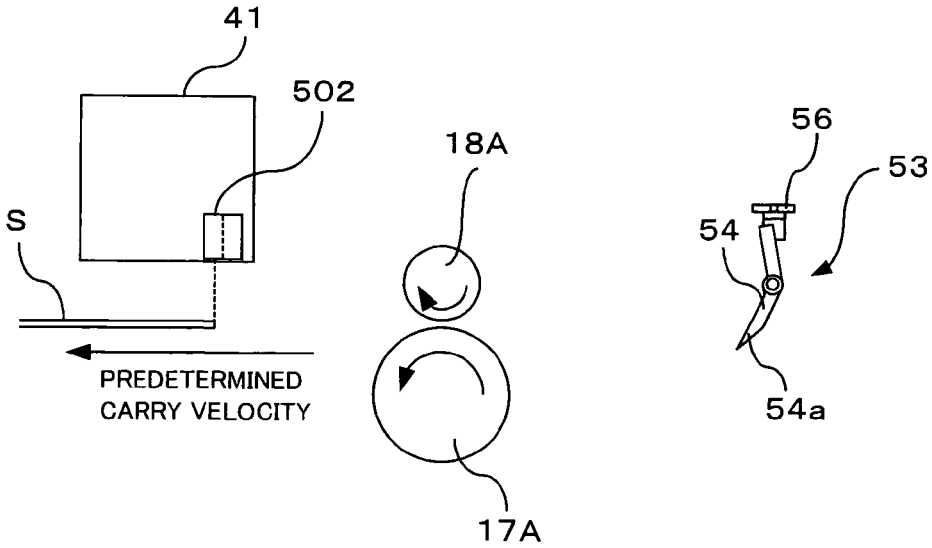

Moreover, as shown in FIG. 16C, when the medium S is carried as it is at the same velocity, that is, the predetermined carry velocity V, and the rear end portion of the medium S reaches below the reflective optical sensor 502, the media non-detection signal is output from the reflective optical sensor 502. When the media non-detection signal is received by the system controller 126, time measurement is finished by the system controller 126.

In this way, it is possible to easily obtain the elapsed time tm by measuring time using the system controller 126.

It should be noted that, with the inkjet printer 1 according to the present embodiment, the time Δt0 is obtained from the simultaneous equations of the Equations (2) and (3) in order to omit the obtaining of the distance L (see FIG. 15) from the point P1 to the point P2. In this way, the medium S is carried twice at different carry velocities V1 and V2 to obtain the two elapsed times tm1 and tm2.

<Flow of Obtaining Measurement Data>

Figure 17:
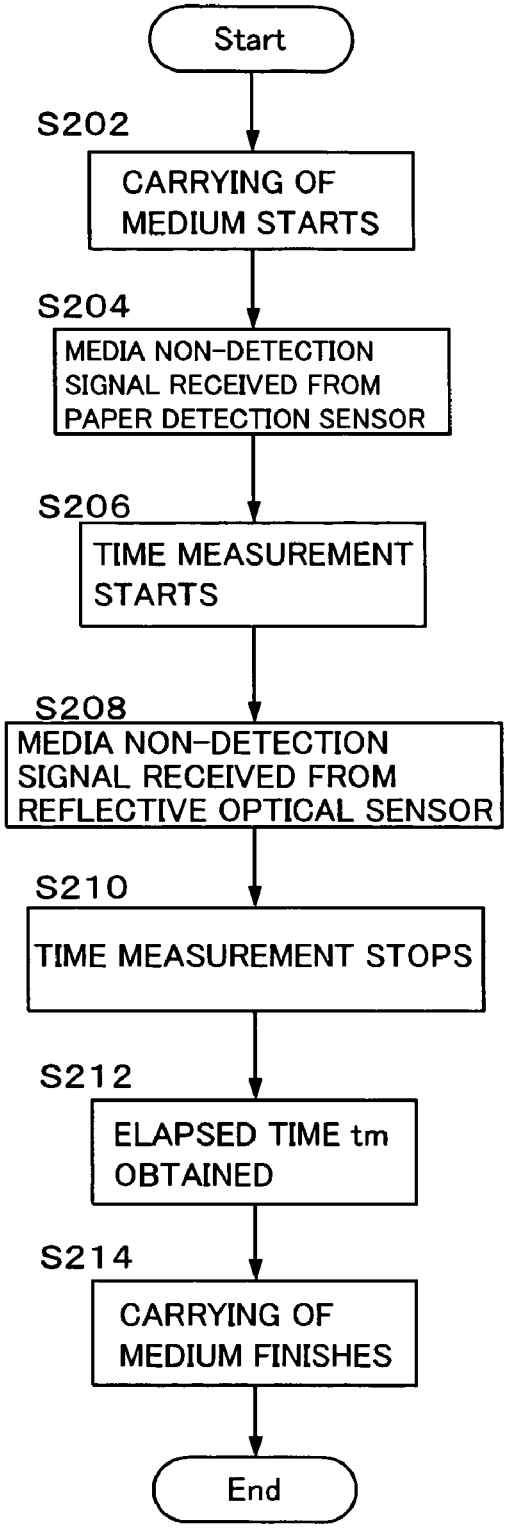
FIG. 17 is a flowchart for describing the procedure to obtain measurement data.

FIG. 17 is a flowchart showing an example of a processing procedure of the system controller 126 when obtaining measurement data. First, the system controller 126 starts carrying the medium S at the predetermined carry velocity V (S202). When the rear end portion of the medium S that is carried reaches the tip end portion 54*a* of the lever 54 of the paper detection sensor 53 and the medium S separates from the lever 54, a media non-detection signal is output from the paper detection sensor 53. When the system controller 126 receives the media non-detection signal from the paper detection sensor 53 (S204), then time measurement is started (S206) in order to obtain the elapsed time tm.

Then, when the medium S is further carried at the predetermined carry velocity V and the rear end portion of the medium S comes below the reflective optical sensor 502, the media non-detection signal is output from the reflective optical sensor 502. When the system controller 126 receives the media non-detection signal from the reflective optical sensor 502 (S208), time measurement is immediately stopped (S210).

In this way, the system controller 126 obtains the elapsed time tm from when the media non-detection signal from the paper detection sensor 53 is received until the media non-detection signal from the reflective optical sensor 502 is received (S212), and the carrying of the medium S is finished (S214). Then the process is ended.

It should be noted that, as in the inkjet printer 1 according to the present embodiment, when the medium S is carried twice at different carry velocities to obtain two elapsed times tm1 and tm2, the system controller 126 carries out this process twice. Of course, with a printing apparatus according to the present invention, there is no limitation to performing this process twice and the process can be carried out three times or more.

Based on, for example, the Equation (4) with the thus-obtained elapsed times tm (tm1 and tm2), the system controller 126 calculates the time Δt0 from when the lever 54 of the paper detection sensor 53 and the medium S enter a non-contact state until the media non-detection signal output from the paper detection sensor 53 is received by the system controller 126.

The system controller 126 then stores the calculated time Δt0 as measurement data in the main memory 127. It should be noted that, with the inkjet printer 1 according to the present embodiment, the distance L (see FIG. 15) from the point P1 at which the lever 54 and the medium S separate until the point P2 at which the medium S is detected by the reflective optical sensor 502 is also calculated based on the calculated time Δt0, and the distance L is also stored as measurement data in the main memory 127.

<Measurement Timings>

The following timings may be adopted for measuring the time Δt0 from when the lever 54 of the paper detection sensor 53 and the medium S enter a non-contact state until the media non-detection signal output from the paper detection sensor 53 is received by the system controller 126.

(A) Measurement at Time of Shipping from Factory

In an inspection process or the like after being manufactured at a factory and before being shipped as a product, measurements are carried out as described above for each machine to obtain the time Δt0. The obtained time Δt0 is stored in the main memory 127 for example inside the printing apparatus.

(B) User Based Settings

After being purchased as a product by a user, measurements are carried out by the user. The user is made to actually set the medium S, then the printing apparatus carries the medium S at a predetermined carry velocity and the elapsed time tm from when the system controller 126 receives the media non-detection signal from the paper detection sensor 53 until the system controller 126 receives the media non-detection signal from the reflective optical sensor 502 is measured. Then, the system controller 126 determines the time Δt0 from the elapsed time tm that is measured and stores it in a memory such as the main memory 127.

It should be noted that in addition to the timings (A) and (B), different timings can be set as the timing at which the time Δt0 is measured.

<Other Methods for Obtaining Measurement Data>

(1) In the above-described embodiment, the paper detection sensor 53, which serves as the "contact sensor", is arranged upstream with respect to the carrying direction of the medium S and the reflective optical sensor 502, which serves as the non-contact sensor, was arranged downstream, but the present invention is not limited to this arrangement, and a non-contact sensor such as the reflective optical sensor 502 may be arranged upstream in the carrying direction of the medium S and a contact sensor such as the paper detection sensor 53 may be arranged downstream in the carrying direction of the medium S. Even when arranged in this way, the measurement data (the time Δt0) can be obtained.

(2) In the above-described embodiment, the medium S was carried twice at different carry velocities, but the present invention is not limited to this, and the medium S can be carried three or more times at different carry velocities. Furthermore, it is also possible to repetitively carry the medium S at the same carry velocity. In such cases, it becomes possible to obtain more accurate measurement data (time Δt0). Furthermore, if the value of L (the distance from the point P1 at which the lever 54 and the medium S separate until the point P2 at which the medium S is detected by the reflective optical sensor 502) or the like is known, then it is only necessary to carry the medium S once.

===Example of Using Measurement Data===

The following is a description concerning use of the time Δt0 (measurement data) from when the lever 54 of the paper detection sensor 53 and the medium S enter a non-contact state until the media non-detection signal output from the paper detection sensor 53 is received by the system controller 126, which is measured and obtained as described above.

In the example below, using the measurement data (time Δt0), the system controller 126 obtains the positional information of the medium S at a time Δt0 before the timing of the signal indicating that the medium S is not being detected, that is, the timing at which the media non-detection signal is received from the paper detection sensor 53, and from this positional information determines the current position of the rear end portion of the medium S.

The positional information of the medium S is obtained from the main memory 127 or the like. More specifically, the carry amount of the medium S carried by the carry roller 17A is stored in the main memory 127 or the like at every predetermined time interval (for example, every 100 μs). Information about the carry amount of the medium S is obtained from the rotary encoder 134. Upon receiving the media non-detection signal that is output from the paper detection sensor 53, the system controller 126 obtains information about the carry amount of the medium S of the time Δt0 before (for example, 800 μs before) the timing that the media non-detection signal was received from the main memory 127 or the like. The system controller 126 also obtains information about the current carry amount of the medium S from the rotary encoder 134. The system controller 126 then calculates the current position of the rear end portion of the medium S from the information about the carry amount of the medium S of the time Δt0 before the timing at which it received the media non-detection signal and the information about the obtained current carry amount of the medium S. It should be noted here that, by obtaining the information about the current carry amount of the medium S from the rotary encoder 134, the current position of the rear end portion of the medium S can be calculated by the system controller 126 at any time after it receives the media non-detection signal that is output from the paper detection sensor 53.

Figure 18:
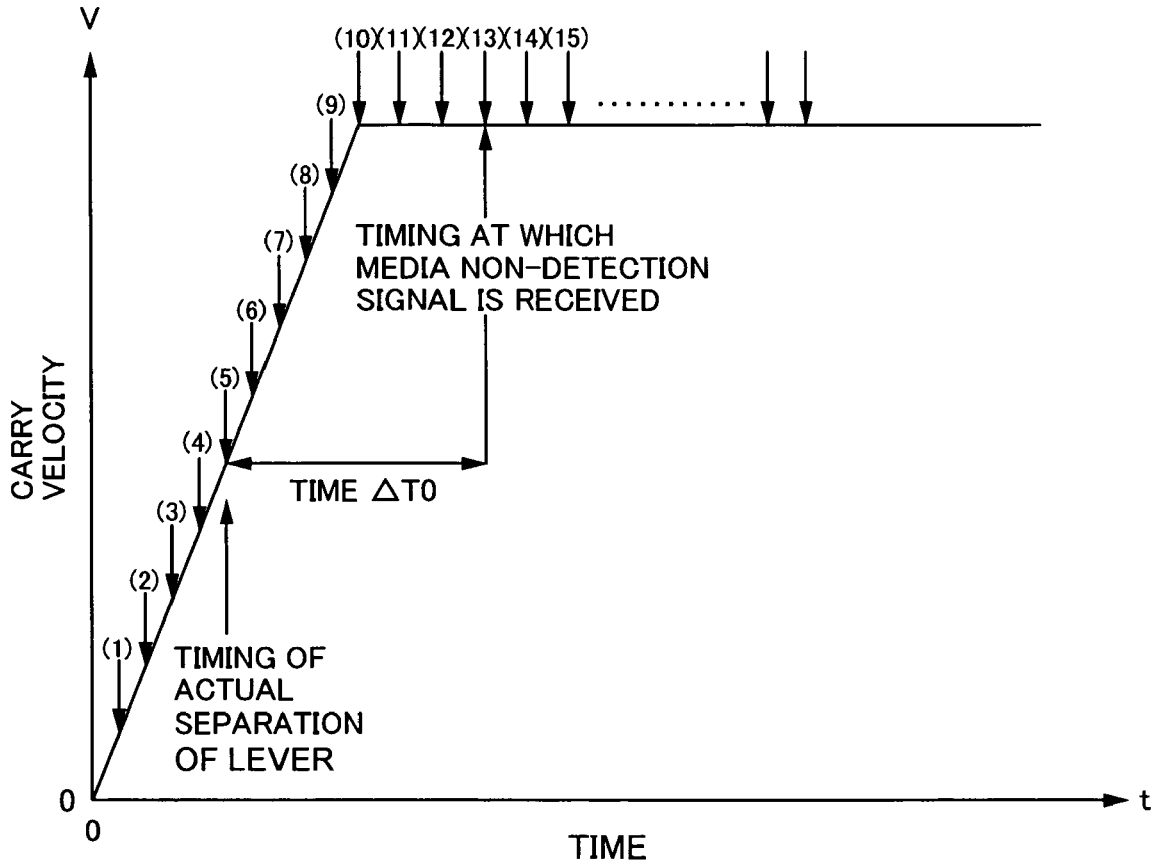
FIG. 18 is an explanatory diagram for describing an example of use of the measurement data.

FIG. 18 illustrates the timings at which the carry amounts of the medium S are stored. In this figure, the vertical axis indicates the carry velocity of the medium S and the horizontal axis indicates time. FIG. 19 illustrates the data structure of the information about the carry amounts of the medium S stored in the main memory 127 and the times at which the information is obtained (referred to as "obtained time").

As illustrated in FIG. 18, the carry amounts of the medium S are obtained from the rotary encoder 134 at every predetermined time interval, regardless of whether the medium S is being accelerated or decelerated, and stored in the main memory 127 or the like. Here, the predetermined time interval is set to a time interval much shorter than the time Δt0. For example, if the time Δt0 is 1,000 μs, then the predetermined time interval is set to, for example, 100 μs. Accordingly, no matter what value the measurement data (time Δt0) is set at, an accurate carry amount can be obtained.

As shown in FIG. 19, information about the carry amounts of the medium S obtained from the rotary encoder 134 and information about the times at which that information was obtained are associated and stored in the main memory 127. As there is a limit to the amount of data the main memory 127 can store, old information is successively eliminated from the main memory 127 after a predetermined time has elapsed. Then, new information is successively written to the main memory 127.

When the system controller 126 receives the media non-detection signal that is output from the paper detection sensor 53, the system controller 126 obtains from the main memory 127 information about the carry amount of the medium S of the time Δt0 before the timing that media non-detection signal was received. For example, when the timing at which the system controller 126 received the media non-detection signal that was output from the paper detection sensor 53 is the thirteenth (13th) timing in FIG. 18, and the information about the carry amount of the medium S at the time Δt0 before this timing is information corresponding to the fifth timing for example, then the information "1,300" (see FIG. 19) is read out from the main memory 127 as the information about the carry amount of the medium S. In this way, the system controller 126 can obtain information about the carry amount of the medium S of the time when the medium S and the paper detection sensor 53 actually went into a non-contact state.

Then, even after receiving the media non-detection signal that is output from the paper detection sensor 53, that is, even after the paper detection sensor 53 and the medium S have separated, by obtaining information about the current carry amount of the medium S from the rotary encoder 134, the system controller 126 can calculate the current position of the rear end portion of the medium S from the information about the carry amounts of the medium S obtained from the main memory 127 and the information about the current carry amount of the medium S obtained from the rotary encoder 134.

By being able to calculate the current position of the rear end portion of the medium S in this way, it is possible for example to easily determine the timing at which the rear end portion of the medium S passes the carry roller 17A and also to control ink ejection such that ink is not ejected to an area much beyond the rear end portion when executing "borderless printing" in which printing is carried out on the rear end portion of the medium S.

===Effects===

With the inkjet printer 1 according to the present embodiment, by storing in the main memory or the like measurement data of the time Δt0 from when the lever 54 of the paper detection sensor 53 and the medium S enter a non-contact state until the media non-detection signal that is output from the paper detection sensor 53 is received by the system controller 126, it is possible to easily calculate the current position of the rear end portion of the medium S based on the relevant time Δt0. Accordingly, it is possible for example to easily determine the timing at which the rear end portion of the medium S passes the carry roller 17A, and also to control ink ejection such that ink is not ejected to an area much beyond the rear end portion when executing "borderless printing" in which printing is carried out on the rear end portion of the medium S.

===Configuration of the Printing System and the Like===

The following is a description of an example of a printing system provided with an inkjet printer as a printing apparatus, as one example of a printing system according to the present invention.

Figure 20:
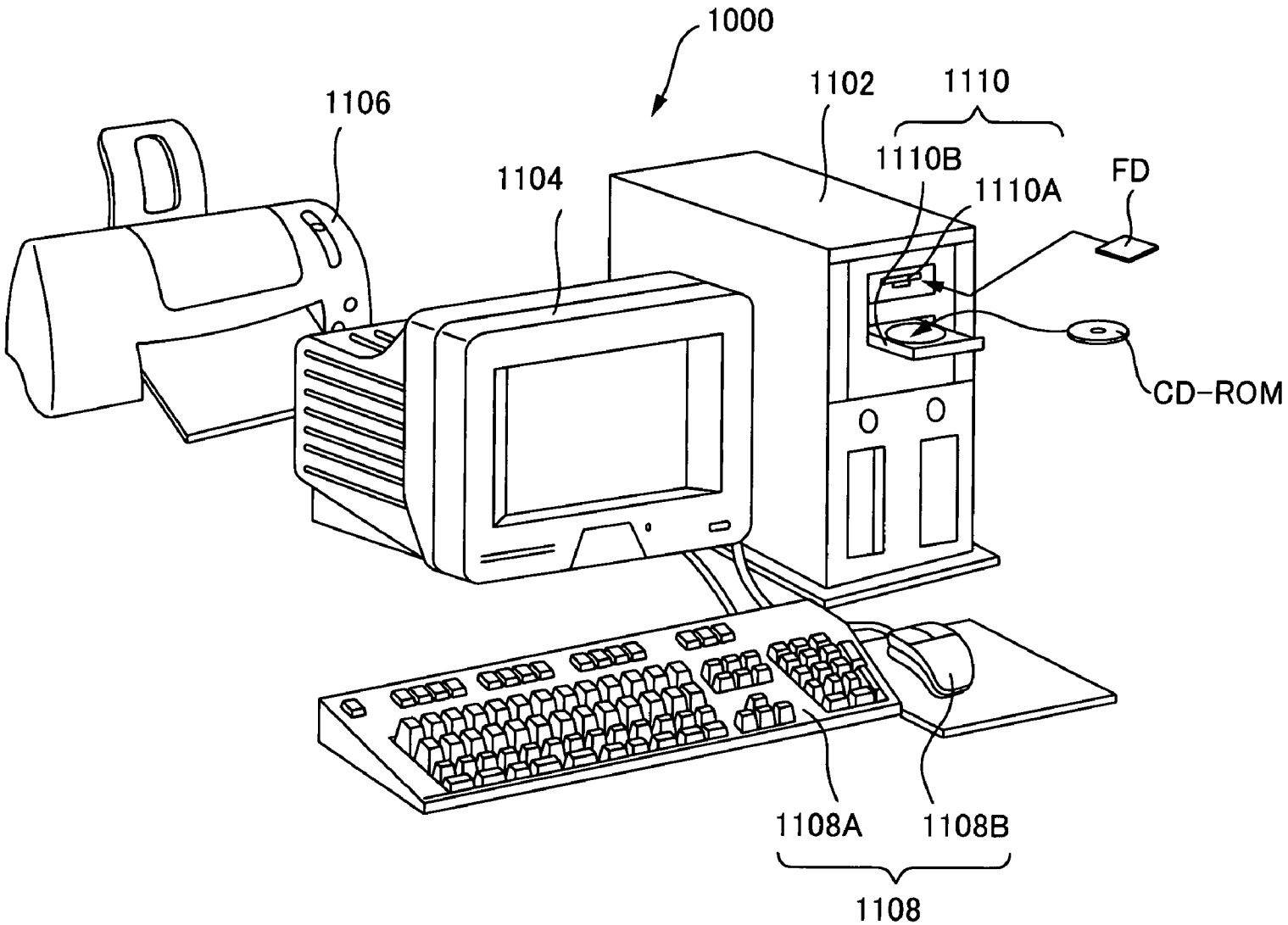
FIG. 20 is a perspective view of one embodiment of a printing system according to the present invention.

FIG. 20 is an explanatory diagram showing the external structure of the printing system. A printing system 1000 is provided with a main computer unit 1102, a display device 1104, a printing apparatus 1106 such as the inkjet printer 1, an input device 1108, and a reading device 1110. In this embodiment, the main computer unit 1102 is accommodated within a mini-tower type housing; however, there is no limitation to this. A CRT (cathode ray tube), plasma display, or liquid crystal display device, for example, is generally used as the display device 1104, but there is no limitation to this. The printer described above is used in the printing apparatus 1106. In this embodiment, the input device 1108 is constituted by a keyboard 1108A and a mouse 1108B, but there is no limitation to these. In this embodiment, a flexible disk drive device 1110A and a CD-ROM drive device 1110B are used as the reading device 1110, but the reading device 1110 is not limited to these, and, for example, it can also be an MO (magnet optical) disk drive device, a DVD (digital versatile disk) and the like.

Figure 21:
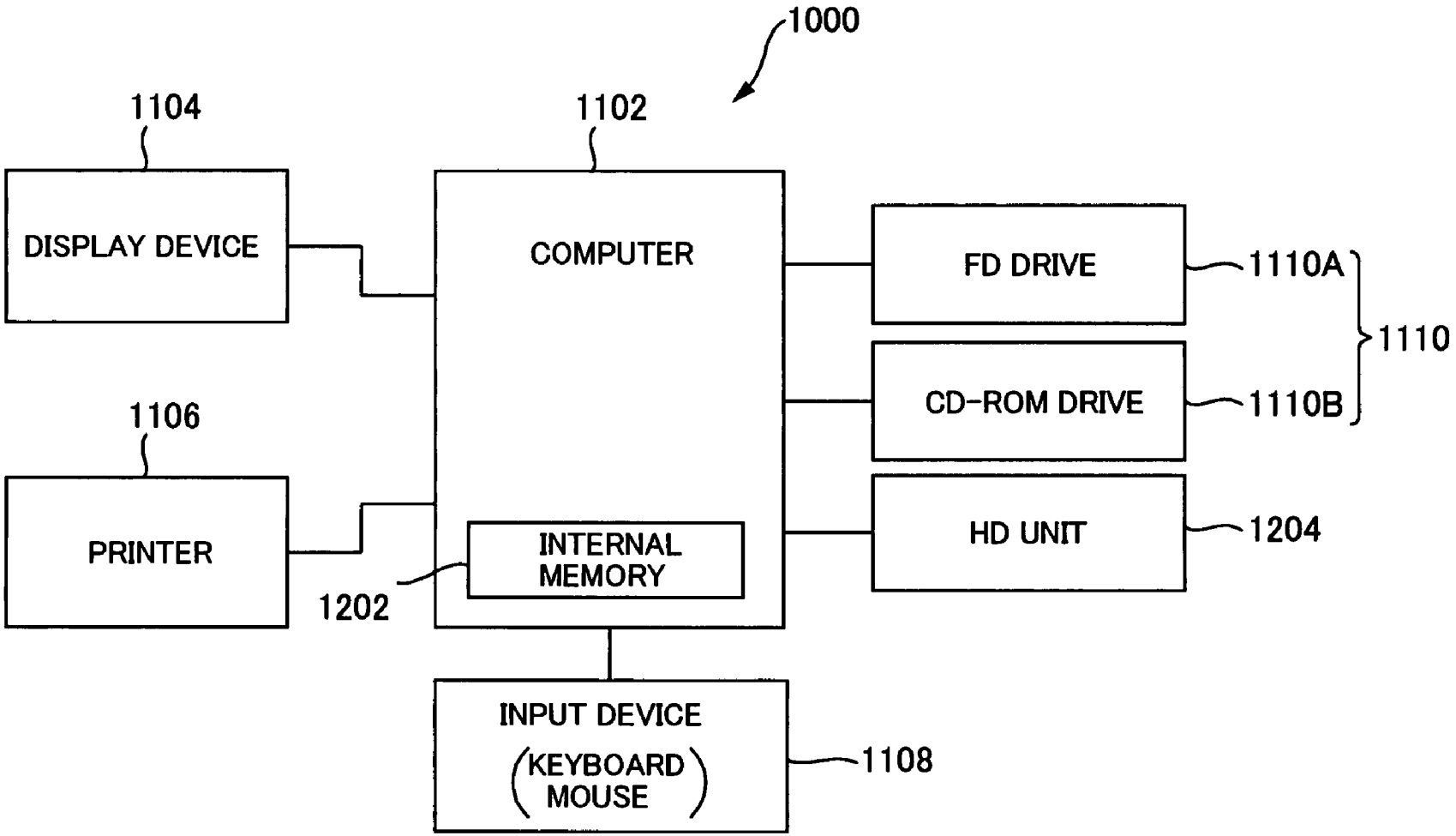
FIG. 21 is a block diagram showing the configuration of the printing system shown in FIG. 20.

FIG. 21 is a block diagram showing the configuration of the printing system illustrated in FIG. 20. An internal memory 1202 such as a RAM is provided within the housing accommodating the main computer unit 1102, and an external memory such as a hard disk drive unit 1204 is further provided.

A computer program for controlling the operation of the above described inkjet printer 1 can be downloaded to the computer 1000 connected to the printing apparatus 1106, for example, via a communications line such as the Internet, but it can also be stored on a computer-readable storage medium and distributed. Various types of storage media can be used as this storage medium, including flexible disks FDs, CD-ROMS, DVD-ROMS, magneto optical disks MOs, hard disks, and memories. It should be noted that information stored on such storage media can be read by various types of reading devices 1110.

It should be noted that, in the above description, an example was described in which the printing system is constituted by connecting the printing apparatus 1106 to the main computer unit 1102, the display device 1104, the input device 1108, and the reading device 1110, but there is no limitation to this. For example, the printing system can be constituted by the main computer unit 1102 and the printing apparatus 1106, and the printing system does not have to be provided with all of the display device 1104, the input device 1108, and the reading device 1110. Furthermore, it is also possible for the printing apparatus 1106 to have some of the functions or mechanisms of the main computer unit 1102, the display device 1104, the input device 1108, and the reading device 1110, respectively. As one example, the printing apparatus 1106 can be configured so as to have an image processing section for carrying out image processing, a display section for carrying out various types of displays, and a recording media attachment/detachment section to and from which recording media storing image data captured by a digital camera or the like are inserted and taken out.

As an overall system, the printing system that is thus achieved is a system that is superior to conventional systems.

===Other Embodiments===

In the foregoing, a printing apparatus such as a printer according to the invention was described based on an embodiment thereof. However, the foregoing embodiment is for the purpose of elucidating the present invention and is not to be interpreted as limiting the present invention. The invention can of course be altered and improved without departing from the gist thereof and of course includes functional equivalents. In particular, the embodiments mentioned below are also included in the printing apparatus according to the invention.

Furthermore, in this embodiment, some or all of the configurations achieved by hardware can be replaced by software, and conversely, some of the configurations that are achieved by software can be replaced by hardware.

Furthermore, a part of the processes carried out on the printing apparatus side can be carried out on the host side, and it is also possible that a special-purpose processing device is interposed between the printing apparatus and the host such that some of the processes are to be carried out by the processing device.

<Regarding the Carrying Mechanism>

In the above-described embodiment, a structure provided with such components as the paper feed motor 15, the carry roller 17A, and the paper discharge roller 17B were disclosed as a carrying mechanism of the present invention, but the carrying mechanism of the present invention is not limited to such a mechanism and any mechanism can be used as long as it is a mechanism capable of carrying the medium S.

<Regarding the Printing Section>

In the above-described embodiment, the nozzles #1 to #180 that eject ink and are arranged in the head 21 as shown in FIG. 5 were described as an example of the printing section of the present invention, but the printing section of the present invention is not limited to such nozzles #1 to #180 that eject ink, and can be a printing section provided with an ink ejection portion of another form or a printing section that carries out printing on the medium S using a different technique other than ink ejection. For example, as long as it carries out printing with respect to the medium S using any technique such as carrying out printing on the medium S using a dot impact technique, or carrying out printing on the medium S using a laser beam technique, or a thermal transfer technique, or a sublimation technique, it corresponds to a printing section of the present invention.

<Regarding the Contact Sensor>

In the above-described embodiment, the paper detection sensor 53 provided with lever 54 that rotates due to contact with the medium S was described as the contact sensor of the present invention, but the contact sensor of the present invention is not limited to the paper detection sensor 53 provided with the lever 54, and can be any type of sensor as long as it is a sensor that detects the medium S by coming into contact with the medium S.

Furthermore, in the above-described embodiment, the paper detection sensor 53 which is the contact sensor of the present invention, was installed on the paper supply side of the printing apparatus (inkjet printer 1), but a printing apparatus according to the present invention is not limited to such an arrangement, and the sensor can be installed in any location as long as it is a sensor that detects the medium S by coming into contact with the medium S being carried.

<Regarding the Non-Contact Sensor>

In the above-described embodiment, the reflective optical sensor 502 was used as the non-contact sensor of the present invention, but the non-contact sensor of the present invention is not limited to the reflective optical sensor 502, and as long as it is capable of non-contact detection of the medium S being carried, it can be another type of sensor such as another type of optical sensor.

Furthermore, in the above-described embodiment, the reflective optical sensor 502 serving as the non-contact sensor of the present invention was arranged at the carriage 41 and arranged such that it could move relatively with respect to the medium S (platen 14), but the non-contact sensor of the present invention is not limited to such an arrangement and, in particular, it is not necessary for the sensor to be arranged at the carriage 41 and it is not necessary for the sensor to be arranged such that it can move relatively with respect to the medium S (platen 14). The non-contact sensor of the present invention can be arranged in any location as long as it is capable of non-contact detection of the medium S being carried.

Furthermore, in the above-described embodiment, the non-contact sensor (the reflective optical sensor 502) of the present invention was used in obtaining the measurement data, but it is not necessarily required to use the non-contact sensor (the reflective optical sensor 502) in obtaining the measurement data in the present invention.

<Regarding the Memory>

In the above-described embodiment, the main memory 127 constituted by a ROM or RAM or the like was disclosed as the memory of the present invention, but the memory of the present invention is not limited to the main memory 127 and can be any device as long as it is capable of reading and writing data. For example, it can be constituted by various types of storages, such as a hard disk device.

<Regarding the Controller>

In the above-described embodiment, the system controller 126 that controls the carrying section, the printing section, and the like was disclosed as the controller of the present invention, but the controller of the present invention is not limited to such system controller 126, and can be any type of controller as long as it is capable of receiving a signal that is output from a contact sensor (the paper detection sensor 53) or a non-contact sensor (the reflective optical sensor 502).

<Regarding the Printing Apparatus>

In the above-described embodiment, the inkjet printer 1 was described as an example of the printing apparatus according to the present invention, but the printing apparatus according to the present invention is not limited to such a printing apparatus and can be an apparatus of any form as long as it is an apparatus that carries out printing with respect to a medium, for example a dot impact printer or a laser beam printer and the like.

<Regarding the Medium>

As for the medium, it is possible to use regular paper, matte paper, cut paper, glossy paper, roll paper, paper used for a specific purpose, photographic paper, and rolled photographic paper, for example, and in addition to these, it is also possible to use film material such as OHP film or glossy film, cloth material, and sheet metal material. In other words, any medium can be used, as long as ink can be ejected onto it.

<Regarding the Printing System>

In the above-described embodiment, a configuration in which an inkjet printer was connected to a main computer unit was described as the printing system according to the present invention, but in regards to the printing system of the present invention, the printing apparatus connected to the main computer unit is not limited to such inkjet printer, and other types of printing apparatuses can be used. For example, it can be an apparatus of any form as long as it is an apparatus that carries out printing with respect to a medium S, for example, a dot impact printer, a laser beam printer, or the like.

Furthermore, in the above-described embodiment, the printing system of a configuration provided with a display device 1104, an input device 1108, and a reading device 1110 in addition to the main computer unit 1102 is described, but it is not necessary for the printing system of the present invention to be configured in this way, and it is sufficient if the computer main unit 1102 is provided, in addition to the printing apparatus.

What is claimed is:

1. A printing apparatus comprising:

a carrying mechanism that carries a medium;

a printing section that carries out printing with respect to said medium;

a contact sensor that detects said medium by coming into contact with said medium that is carried by said carrying mechanism;

a controller that receives a signal that is output from said contact sensor, and obtains measurement data of a time from when said contact sensor and said medium enter a non-contact state until a signal that is output from said contact sensor and that indicates that said medium is not being detected is received by said controller; and a memory that stores sad measurement data of time obtained by said controller.

2. A printing apparatus according to claim 1, wherein a timing at which said contact sensor and said medium enter a non-contact state is obtained based on said measurement data stored in said memory and a timing at which a signal that is output from said contact sensor and that indicates that said medium is not being detected is received by said controller.

3. A printing apparatus according to claim 2, wherein a position of said medium being carried by said carrying mechanism is detected based on the timing at which said contact sensor and said medium enter a non-contact state and a carry amount by which said carrying mechanism carries said medium.

4. A printing apparatus according to claim 1, wherein said printing apparatus further comprises a non-contact sensor that is arranged at a position away from said contact sensor and that is adapted to detect, in a non-contact state, said medium carried by said carrying mechanism.

5. A printing apparatus according to claim 4, wherein said non-contact sensor is an optical sensor.

6. A printing apparatus according to claim 4, wherein said measurement data is obtained based on a detection signal regarding said medium that is output from said contact sensor and a detection signal regarding said medium that is output from said non-contact sensor.

7. A printing apparatus according to claim 1, wherein said medium is carried at a predetermined carry velocity by said carrying mechanism when obtaining said measurement data.

8. A printing apparatus according to claim 7, wherein said medium is carried at least two times at different carry velocities by said carrying mechanism when obtaining said measurement data.

9. A printing apparatus according to claim 1, wherein said contact sensor comprises a lever that rotates by coming into contact with said medium.

10. A printing apparatus comprising:

a carrying mechanism that carries a medium;

a printing section that carries out printing with respect to said medium;

a contact sensor that detects said medium by coming into contact with said medium that is carried by said carrying mechanism;

a controller that receives a signal that is output from said contact sensor, and obtains measurement data of a time from when said contact sensor and said medium enter a non-contact state until a signal that is output from said contact sensor and that indicates that said medium is not being detected is received by said controller; and a memory that stores said measurement data of time obtained by said controller, wherein a timing at which said contact sensor and said medium enter a non-contact state is obtained based on said measurement data stored in said memory and a timing at which a signal that is output from said contact sensor and that indicates that said medium is not being detected is received by said controller;

wherein a position of said medium being carried by said carrying mechanism is detected based on the timing at which said contact sensor and said medium enter a non-contact state and a carry amount by which said carrying mechanism carries said medium;

wherein said printing apparatus further comprises a non-contact sensor that is arranged at a position away from said contact sensor and that is adapted to detect, in a non-contact state, said medium carried by said carrying mechanism;

wherein said non-contact sensor is an optical sensor;

wherein said measurement data is obtained based on a detection signal regarding said medium that is output from said contact sensor and a detection signal regarding said medium that is output from said non-contact sensor;

wherein said medium is carried at a predetermined carry velocity by said carrying mechanism when obtaining said measurement data;

wherein said medium is carried at least two times at different carry velocities by said carrying mechanism when obtaining said measurement data; and wherein said contact sensor comprises a lever that rotates by coming into contact with said medium.

11. A media detection apparatus comprising:

a contact sensor that detects a medium by coming into contact with said medium that is carried by a carrying mechanism;

a controller that receives a signal that is output from said contact sensor and obtains measurement data of a time from when said contact sensor and said medium enter a non-contact state until a signal that is output from said contact sensor and that indicates that said medium is not being detected is received by said controller; and a memory that stores said measurement data of time obtained by said controller.

12. A method of detecting a medium, comprising the steps of:

obtaining measurement data of a time from when a medium and a contact sensor of a media detection apparatus that detects said medium enter a non-contact state until a signal that is output from said contact sensor and that indicates that said medium is not being detected is received by said controller; and storing said time that has been measured in a memory of said media detection apparatus as the measurement data of time.

13. A measurement method comprising the steps of:

detecting a medium that is being carried at a predetermined carry velocity using a contact sensor of a media detection apparatus that detects said medium by coming into contact therewith;

detecting said medium that is being carried at said predetermined carry velocity using a non-contact sensor that is arranged at a position away from said contact sensor and that is adapted to detect, in a non-contact state, said medium; and obtaining measurement data of a time from when a contact sensor and said medium enter a non-contact state until a signal that is output from said contact sensor and that indicates that said medium s not being detected is received by said controller; and storing n a memory said measurement data of tine obtained by said controller.

14. A computer-readable storage medium having recorded thereon a program, said program being executed on a printing apparatus provided with:

a carrying mechanism that carries a medium, a printing section that carries out printing with respect to said medium, a contact sensor that detects said medium by coming into contact with said medium that is carried by said carrying mechanism, a controller that receives a signal that is output from said contact sensor and obtains measurement data of a time from when said contact sensor and said medium enter a non-contact state until a signal that is output from said contact sensor and that indicates that said medium is not being detected is received by said controller; and a memory that stores data comprising said measurement data of time obtained by said controller; and said program executing the steps of:

carrying said medium by said carrying mechanism at a predetermined carry velocity; and when said medium is carried by said carrying mechanism at said predetermined carry velocity, measuring a time from when said medium and said contact sensor enter a non- contact state until a signal that is output from said contact sensor and that indicates that said medium is not being detected is received by said controller, based on:

a signal that is output from said contact sensor, and a signal that is output from a non-contact sensor that is arranged at a position away from said contact sensor and that is adapted to detect, in a non-contact state, said medium being carried by said carrying mechanism.

15. A printing system comprising:

a main computer unit; and a printing apparatus that is connectable to said main computer unit and that is provided with:

a carrying mechanism that carries a medium, a printing section that carries out printing with respect to said medium, a contact sensor that detects said medium by coming into contact with said medium that is carried by said carrying mechanism, a controller that receives a signal that is output from said contact sensor and obtains measurement data of a time from when said contact sensor and said medium enter a non-contact state until a signal that is output from said contact sensor and that indicates that said medium is not being detected s received by said controller; and a memory that stores said measurement data of a time obtained by said controller.

* * * * *